US012060757B2

(12) United States Patent
Eitschberger et al.

(10) Patent No.: US 12,060,757 B2
(45) Date of Patent: Aug. 13, 2024

(54) SELF-ERECTING LAUNCHER ASSEMBLY

(71) Applicant: DynaEnergetics Europe GmbH, Troisdorf (DE)

(72) Inventors: Christian Eitschberger, Munich (DE); Liam McNelis, Bonn (DE); Thilo Scharf, Letterkenny (IE)

(73) Assignee: DynaEnergetics Europe Gmbh, Troisdorf (DE)

( * ) Notice: Subject to any disclaimer, the term of this patent is extended or adjusted under 35 U.S.C. 154(b) by 135 days.

(21) Appl. No.: 17/911,456

(22) PCT Filed: Mar. 18, 2021

(86) PCT No.: PCT/EP2021/057028
§ 371 (c)(1),
(2) Date: Sep. 14, 2022

(87) PCT Pub. No.: WO2021/186004
PCT Pub. Date: Sep. 23, 2021

(65) Prior Publication Data

US 2023/0102057 A1 Mar. 30, 2023

Related U.S. Application Data

(60) Provisional application No. 62/991,125, filed on Mar. 18, 2020.

(51) Int. Cl.
*E21B 23/10* (2006.01)
*E21B 33/068* (2006.01)

(52) U.S. Cl.
CPC ..... *E21B 23/10* (2013.01); *E21B 33/068* (2013.01)

(58) Field of Classification Search
CPC ..... E21B 23/10; E21B 33/068
See application file for complete search history.

(56) References Cited

U.S. PATENT DOCUMENTS 2,713,909 A 7/1955 Baker
2,755,863 A 7/1956 Stansbury et al.
(Continued)

FOREIGN PATENT DOCUMENTS

CA 2833722 A1 5/2014
CN 201546707 U 8/2010
(Continued)

OTHER PUBLICATIONS

Entchev et al., "Autonomous Perforating System for Multizone Completions," SPE 147296, Prepared for Presentation at Society of Petroleum Engineers (SPE) Annual Technical Conference and Exhibition held Oct. 30, 2011-Nov. 2, 2011, 7 pgs.
(Continued)

*Primary Examiner* — Jonathan Malikasim
(74) *Attorney, Agent, or Firm* — Womble Bond Dickinson (US) LLP

(57) ABSTRACT

A self-erecting launcher assembly includes a mobile unit, and a magazine positioned in a receptacle of the mobile unit. The magazine includes a plurality of drones. A rail unit is secured to the mobile unit and moves between a closed position and an elevated position. A platform may be secured to the rail unit and is movable in an upward direction and a downward direction along a length of the rail unit. The platform is movable when the rail unit is in its elevated position. The magazine or the plurality of drones may be positioned on the platform, such that the platform moves the magazine or the plurality of drones from the mobile unit to at least one wellhead. A manipulator arm is secured to the platform and selects a drone of the plurality of drones and delivers the selected drone into a lubricator positioned at the wellhead.

20 Claims, 13 Drawing Sheets

(56) References Cited

U.S. PATENT DOCUMENTS 3,403,729 A * 10/1968 Hickey ..... E21B 33/068 15/104.062
3,493,061 A 2/1970 Gyongyosi
3,669,190 A 6/1972 Sizer et al.
3,710,867 A 1/1973 Bansbach
4,678,390 A * 7/1987 Bonneton ..... B65G 1/1375 414/416.03
5,570,992 A * 11/1996 Lemelson ..... G05B 19/14 901/41
6,044,905 A 4/2000 Harrison, III
6,056,058 A 5/2000 Gonzalez
6,182,765 B1 2/2001 Kilgore
6,269,875 B1 8/2001 Harrison, III et al.
6,454,011 B1 9/2002 Schempf et al.
6,457,526 B1 10/2002 Dailey
6,464,011 B2 10/2002 Tubel
6,474,931 B1 11/2002 Austin et al.
6,488,093 B2 12/2002 Moss
6,659,180 B2 12/2003 Moss
6,719,061 B2 4/2004 Muller et al.
6,808,021 B2 10/2004 Zimmerman et al.
7,018,164 B2 3/2006 Anthis et al.
7,036,598 B2 5/2006 Skjærseth et al.
7,140,453 B2 11/2006 Ayling
7,234,525 B2 * 6/2007 Alves ..... E21B 33/068 166/310
7,240,742 B2 7/2007 Sewell et al.
7,273,102 B2 9/2007 Sheffield
7,331,394 B2 2/2008 Edwards et al.
7,588,080 B2 9/2009 McCoy
7,631,704 B2 12/2009 Hagemeyer et al.
8,006,765 B2 8/2011 Richards et al.
8,136,585 B2 3/2012 Cherewyk
8,151,882 B2 4/2012 Grigar et al.
8,317,448 B2 11/2012 Hankins et al.
8,413,727 B2 4/2013 Holmes
8,505,632 B2 8/2013 Guerrero et al.
8,689,868 B2 4/2014 Lerche et al.
8,899,322 B2 12/2014 Cresswell et al.
8,950,480 B1 2/2015 Strickland
8,981,957 B2 3/2015 Gano et al.
9,284,168 B2 3/2016 Mau et al.
9,556,676 B2 1/2017 Konduc et al.
9,617,829 B2 4/2017 Dale et al.
9,797,238 B2 10/2017 Frosell et al.
9,862,027 B1 1/2018 Loehken
9,903,192 B2 2/2018 Entchev et al.
9,951,563 B2 4/2018 Beaton et al.
9,963,955 B2 5/2018 Tolman et al.
10,100,612 B2 10/2018 Lisowski et al.
10,138,691 B2 11/2018 Kos et al.
10,196,868 B2 2/2019 Layden
10,196,886 B2 2/2019 Tolman et al.
10,246,952 B2 4/2019 Trydal et al.
10,301,910 B2 5/2019 Whitsitt et al.
10,323,484 B2 6/2019 Liess
10,358,880 B2 7/2019 Metcalf et al.
10,584,552 B2 3/2020 Cannon et al.
10,605,037 B2 3/2020 Eitschberger et al.
10,612,332 B1 * 4/2020 Sage ..... B64C 39/024
10,739,115 B2 8/2020 Loehken et al.
10,844,684 B2 11/2020 Eitschberger
10,927,650 B2 2/2021 Schultz et al.
11,047,189 B2 * 6/2021 Fernandes ..... E21B 34/02
11,149,515 B1 10/2021 Bull et al.
11,434,713 B2 * 9/2022 Eitschberger ..... E21B 23/08
11,434,725 B2 * 9/2022 Eitschberger ..... E21B 23/10
11,486,219 B2 * 11/2022 Eitschberger ..... E21B 33/068
2002/0036101 A1 3/2002 Huhdanmaki et al.
2002/0040783 A1 4/2002 Zimmerman et al.
2002/0129941 A1 * 9/2002 Alves ..... E21B 37/06 166/70
2002/0134552 A1 9/2002 Moss
2004/0094305 A1 5/2004 Skjærseth et al.
2004/0216632 A1 11/2004 Finsterwald
2004/0239521 A1 12/2004 Zierolf
2005/0011645 A1 1/2005 Aronstam et al.
2005/0103526 A1 5/2005 Ayling
2005/0217844 A1 10/2005 Edwards et al.
2005/0269083 A1 12/2005 Burris, II et al.
2006/0054326 A1 3/2006 Alves et al.
2008/0223587 A1 9/2008 Cherewyk
2009/0211760 A1 8/2009 Richards et al.
2009/0255728 A1 10/2009 Spencer et al.
2009/0308589 A1 12/2009 Bruins et al.
2010/0288496 A1 11/2010 Cherewyk
2011/0005777 A1 1/2011 Meff
2013/0062055 A1 3/2013 Tolman et al.
2013/0228326 A1 9/2013 Griffith et al.
2014/0083774 A1 3/2014 Hoult et al.
2014/0131035 A1 5/2014 Entchev et al.
2014/0218207 A1 8/2014 Gano et al.
2014/0360720 A1 12/2014 Corbeil
2015/0114626 A1 4/2015 Hatten et al.
2015/0136422 A1 5/2015 Rodgers
2015/0167410 A1 6/2015 Garber et al.
2015/0209954 A1 7/2015 Hokanson
2016/0115741 A1 4/2016 Davis
2016/0215592 A1 7/2016 Helms et al.
2017/0044875 A1 2/2017 Hebebrand et al.
2017/0067303 A1 3/2017 Thiemann et al.
2017/0067320 A1 3/2017 Zouhair et al.
2017/0159379 A1 6/2017 Metcalf et al.
2017/0175488 A1 6/2017 Lisowski et al.
2017/0204687 A1 7/2017 Yorga et al.
2017/0306710 A1 10/2017 Trydal et al.
2017/0314372 A1 11/2017 Tolman et al.
2017/0370169 A1 12/2017 Genovese et al.
2018/0002999 A1 1/2018 Johnson
2018/0003038 A1 1/2018 Cherewyk
2018/0274311 A1 9/2018 Zsolt
2018/0313182 A1 11/2018 Cherewyk et al.
2018/0355674 A1 12/2018 Cooper et al.
2019/0031307 A1 1/2019 Siersdorfer
2019/0186211 A1 6/2019 Gonzalez
2019/0218880 A1 7/2019 Cannon et al.
2019/0316449 A1 10/2019 Schultz et al.
2019/0338606 A1 11/2019 Metcalf et al.
2019/0368301 A1 12/2019 Eitschberger et al.
2020/0056442 A1 2/2020 Cherewyk et al.
2020/0157909 A1 5/2020 Fernandes et al.
2020/0190932 A1 6/2020 Fitschberger
2020/0308924 A1 10/2020 Pitcher
2020/0332618 A1 10/2020 Eitschberger et al.
2021/0040809 A1 2/2021 Eitschberger
2022/0018196 A1 * 1/2022 Gregg ..... E21B 19/20

FOREIGN PATENT DOCUMENTS

CN 204430910 U 7/2015
CN 205577894 U 9/2016
CN 105822223 B 3/2017
DE 10341437 A1 4/2005
DE 10344523 A1 4/2005
EP 2952675 A2 9/2015
EP 2310616 B1 10/2017
GB 2457081 A 8/2009
WO 0133029 A3 5/2001
WO 0133029 A2 12/2001
WO 2011150251 A1 12/2011
WO 2012161854 A2 11/2012
WO 2015081092 A2 6/2015
WO 2015081092 A3 8/2015
WO 2018094220 A1 5/2018
WO 2019033183 A1 2/2019
WO 2019229520 A1 12/2019
WO 2020002383 A1 1/2020
WO 2020002983 A1 1/2020
WO 2020035616 A1 2/2020

(56) References Cited

FOREIGN PATENT DOCUMENTS

WO 2020038848 A1 2/2020

OTHER PUBLICATIONS

International Searchiing Authority, International Search Report and Written Opinion of International App. No. PCT/EP2019/063966, mailed Aug. 30, 2019, 10 pages.
International Searching Authority, International Search Report and Written Opinion for PCT App. No. PCT/IB2019/000526; Sep. 25, 2019, 17 pgs.
International Searching Authority, The International Search Report and Written Opinion of International App. No. PCT/IB2019/000537, mailed Sep. 25, 2019, 18 pgs.
International Searching Authority; Communication Relating to the Results of the Partial International Search for PCT/EP2020/070291; Oct. 20, 2020; 8 pages.
International Searching Authority; International Preliminary Report on Patentability for International Application No. PCT/IB2019/000537; dated Dec. 10, 2020; 11 pages.
International Searching Authority; International Preliminary Report on Patentability for International Application No. PCT/IB2019/000526; dated Dec. 10, 2020; 10 pages.
International Searching Authority; International Preliminary Report on Patentability International Application No. PCT/EP2019/063966; dated Dec. 10, 2020; 7 pages.
International Searching Authority; International Search Report and Written Opinion for PCT App. No. PCT/EP2019/066919; Sep. 10, 2019; 11 pages.
International Searching Authority; International Search Report and Written Opinion for PCT App. No. PCT/EP2019/072032; Nov. 15, 2019; 13 pages.
International Searching Authority; International Search Report and Written Opinion for PCT App. No. PCT/EP2019/072064; Nov. 20, 2019; 15 pages.
International Searching Authority; International Search Report and Written Opinion of the International Searching Authority for PCT/EP2020/070291; Dec. 15, 2020; 14 pages.
United States Patent and Trademark Office, Final Office Action of U.S. Appl. No. 16/542,890, dated May 12, 2020, 16 pgs.
United States Patent and Trademark Office, Non-Final Office Action of U.S. Appl. No. 16/423,230, which is in the same family as U.S. Appl. No. 16/788,107, dated Aug. 27, 2019, 16 pgs.
United States Patent and Trademark Office, Non-final Office Action of U.S. Appl. No. 16/451,440, dated Oct. 24, 2019, 22 pgs.
United States Patent and Trademark Office, Notice of Allowance for U.S. Appl. No. 16/788,107, mailed Jul. 30, 2020, 9 pgs.
United States Patent and Trademark Office; Final Office Action for U.S. Appl. No. 16/451,440; issued Feb. 7, 2020; 11 pages.
United States Patent and Trademark Office; Non-Final Office Action for U.S. Appl. No. 16/542,890; issued Nov. 4, 2019; 16 pages.
United States Patent and Trademark Office; Non-Final Office Action for U.S. Appl. No. 16/542,890; Sep. 30, 2020; 17 pages.
United States Patent and Trademark Office; Notice of Allowance for U.S. Appl. No. 16/451,440; issued Jun. 5, 2020; 8 pages.
USPTO, Final Office Action of U.S. Appl. No. 16/423,230, dated Nov. 4, 2019, 14 pgs.
USPTO, Office Action of U.S. Appl. No. 16/788,107, dated Apr. 6, 2020, 15 pgs.
International Searching Authority; International Preliminary Report on Patentability of the International Searching Authority for PCT/EP2020/065180; mailed on Dec. 21, 2021; 7 pages.
International Searching Authority; International Preliminary Report on Patentability of the International Searching Authority for PCT/EP2021/057028; mailed on Sep. 29, 2022; 8 pages.
International Searching Authority; International Search Report and Written Opinion for PCT Appl PCT/EP2020/065180; Oct. 6, 2020; 11 pages.
International Searching Authority; International Search Report and Written Opinion of the International Searching Authority for PCT/EP2021/057028; mailed on Jun. 29, 2021; 11 pages.
Kort Industries, Self Elevating Drilling System, 9 pgs., Apr. 17, 2020, https://www.kortindustries.com/seds/.
United States Patent and Trademark Office, Final Office Action of U.S. Appl. No. 16/423,230, dated Nov. 4, 2019, 14 pages.
United States Patent and Trademark Office, Non-Final Office Action of U.S. Appl. No. 16/423,230, dated Aug. 27, 2019, 16 pages.
United States Patent and Trademark Office, Non-Final Office Action of U.S. Appl. No. 16/788,107, dated Apr. 6, 2020, 15 pages.
United States Patent and Trademark Office, Notice of Allowance for U.S. Appl. No. 16/423,230, dated Nov. 27, 2019, 7 pages.
United States Patent and Trademark Office, Notice of Allowance for U.S. Appl. No. 16/788,107, dated Jul. 30, 2020, 9 pages.
United States Patent and Trademark Office; Non-Final Office Action for U.S. Appl. No. 16/919,473; dated Feb. 8, 2022; 12 pages.
United States Patent and Trademark Office; Non-Final Office Action for U.S. Appl. No. 17/072,067; dated Mar. 31, 2022; 15 pages.
United States Patent and Trademark Office; Non-Final Office Action for U.S. Appl. No. 17/608,173; dated Mar. 29, 2022; 5 pages.
United States Patent and Trademark Office; Notice of Allowance for U.S. Appl. No. 16/919,473; dated Jun. 14, 2022; 8 pages.
United States Patent and Trademark Office; Notice of Allowance for U.S. Appl. No. 17/072,067; dated Aug. 12, 2022; 10 pages.
United States Patent and Trademark Office; Notice of Allowance for U.S. Appl. No. 17/608,173; dated Jun. 20, 2022; 8 pages.

* cited by examiner

SELF-ERECTING LAUNCHER ASSEMBLY

CROSS-REFERENCE TO RELATED APPLICATIONS

This application is a national stage application of and claims priority to Patent Cooperation Treaty (PCT) Application No. PCT/EP2021/057028 filed Mar. 18, 2021, which claims the benefit of U.S. Provisional Application No. 62/991,125 filed Mar. 18, 2020, the entire contents of which are incorporated herein by reference in their entireties.

BACKGROUND

Oil and gas reserves are accessed using various drilling and completion techniques. The drilling techniques require preparation of a drilling site by the formation of a wellbore 50, as illustrated in FIG. 1. A wellbore 50 is a narrow shaft drilled in the ground, vertically and/or horizontally as well as angles therebetween. A wellbore 50 can include a substantially vertical portion and a substantially horizontal portion. The vertical portion of a typical wellbore 50 may be over a mile in depth, while the horizontal portion may be several miles in length due to longer laterals and advancements in horizontal drilling.

A tool 31 or tool string 31' is typically introduced into a wellbore 50 by attaching a lubricator 23 to a blowout preventer 25 at the wellhead 30 of a well casing. The lubricator 23 is a series of large diameter tubular members assembled on top of wellhead 30 and may include a grease injection tube and/or stuffing box 27 through which a wireline 24 for suspending the tool 31 is passed. The lubricator 23 is typically long, heavy and difficult to manipulate in the rig 26. It may also be difficult to make the required connections to a lubricator 23. After the lubricator 23 and stuffing box 27 have been assembled, the lubricator 23 is hoisted into position on the blowout preventer 25 and secured thereto. Pressure between the wellbore 50 and lubricator 23 is equalized by valves around the blowout preventer 25. The blowout preventer 25 is then opened allowing access to the borehole. After the blowout preventer 25 has been opened, the tool 31 can be lowered into the wellbore 50 by a wireline 24 with the grease injection tube or stuffing box 27 providing a seal around the wireline 24 as the tool 31 is lowered.

Once the tool has served its desired purpose in the wellbore 50, the tool 31 is extracted from the wellbore 50 by drawing it up to a position within the lubricator 23, closing the blowout preventer 25, venting the lubricator 23, and removing the tool 31. When no more tools will be deployed in the wellbore, the lubricator 23 may be removed from the blowout preventer 25 and lowered to a position where it can be subsequently disassembled into its individual components. It will be appreciated from the foregoing description that there are a number of difficulties in such an operation, including knowing when the tool 31 has been fully withdrawn into the lubricator 23, not pulling the wireline 24 so taut against the stuffing box 27 that there is a possibility of the wireline 24 being broken with the result being the tool 31 falling downhole before the blowout preventer 25 can be closed, and closing the blowout preventer 25 on the tool 31 before it is fully withdrawn into the lubricator 23. Of course, handling the tool 31 during the extraction process is equally as difficult as handling it during the insertion process.

A wireline, electric line, or e-line 24 is cabling technology used to lower and retrieve tools 31 into and out of the wellbore 50 for the purpose of delivering an explosive charge, evaluation of the wellbore 50, or other completion-related or closure-related tasks. The equipment/devices disposed in the wellbore 50 are often generically referred to as downhole tools and examples of such tools 31 are perforating guns, puncher guns, logging tools, jet cutters, plugs, frac plugs, bridge plugs, setting tools, self-setting bridge plugs, self-setting frac plugs, mapping/positioning/orientating tools, bailer/dump bailer tools, and ballistic tools. Such downhole tools 31 are typically attached to the wireline 24, fed through or run inside the casing or tubing, and are lowered into the wellbore 50. Other methods include tubing conveyed (i.e., TCP for perforating) or coil tubing conveyance. The speed of unwinding the wireline cable 24 and winding the wireline cable 24 back up is limited based on a speed of the wireline equipment rig 26 and forces on the wireline cable 24 itself (e.g., friction within the well). Because of these limitations, it typically takes several hours for the wireline cable 24 and the attached tool 31 or tool-string 31' to be lowered into the wellbore 50 and another several hours for the wireline cable 24 to be wound back up and the toolstring 31' retrieved. When detonating explosives, the wireline cable 24 will be used to position a downhole tool 31 or toolstring 31' into the wellbore 50.

This type of deployment process requires the selection of a downhole tool 31, the attachment of that tool 31 or a combination of tools in a toolstring 31' to the wireline 24, and in some instances, the removal of the downhole tool(s) 31 from the wellbore 50. When an operator needs to deploy additional downhole tools 31 into the wellbore 50, which may be the same as or different from previously-deployed tool(s), the operator must first retract/retrieve the wireline 24 from the wellbore 50 and then attach the wireline 24 to the additional downhole tool(s) 20. That is, no practical means exists for disposing more than one wireline 24 into a wellbore 50 during typical operations. This completion process requires multiple steps, a significant array of equipment, and can be time consuming and costly. Furthermore, equipment lodged in the wellbore will typically result in complication, delay, additional human resource time, equipment cost and, often, exorbitant expense to operations.

The various drilling and completion operations requiring deployment of various downhole tools 31, as well as the changing between different types of tools being deployed, currently require direct human interaction with the wireline 24, the tools 31 on the wireline 24, and the feeding of tools/wireline into the equipment attached to the wellhead 30. Wellhead 30 is a general term used to describe the pressure-containing component at the surface of an oil well that provides the interface for drilling, completion, and testing of all subsurface operation phases. Being pressurized and the pressurization subject to an unknown level of variability, in addition to the substantial amount of shifting equipment adjacent the wellhead 30, the area around the wellhead 30 is referred to as a 'red zone'. That is, the dangers inherent in drilling and completion operations are focused in the area within a few yards or tens of yards around the wellhead 30. During operations, only trained personnel are permitted within a certain distance of the wellhead 30 and those personnel must be properly protected. Even then, the activities of attaching and detaching tools 31 from a wireline 24, disposing a wireline 24 and attached toolstring 31' into the wellbore 50 and retrieving a wireline 24 and the attached toolstring 31' from the wellbore 50, are inherently difficult, dirty and dangerous.

In view of the disadvantages associated with currently available devices and methods for well completion, there is a need for a device and method that increases the efficiency of the completion processes. There is a further need for a device and method that reduces the steps, time to achieve steps, time between steps and associated costs and equipment for well completion processes. There is a further need for a system and method that reduces the delay between drilling of a wellbore and production of oil or gas from the wellbore. In light of the dangers of disposing and retrieving tools from a wellbore, there is also a need to reduce or eliminate the number of persons in the red zone adjacent the wellhead, especially during particularly risk prone activities.

BRIEF SUMMARY

Embodiments of the disclosure are associated with a self-erecting launcher assembly. The launcher assembly includes a mobile unit, and a magazine positioned in a receptacle of the mobile unit. According to an aspect, the magazine includes a plurality of drones. A rail unit is secured to the mobile unit 400 and is configured to move between a closed position and an elevated position. According to an aspect, a platform 600 is secured to the rail unit and is movable in an upward direction and a downward direction along a length of the rail unit. The platform 600 may be movable sideways. is side-by-side direction in order to orient a manipulator arm. The platform is movable when the rail unit is in its elevated position. According to an aspect, the magazine or the plurality of drones may be positioned on the platform, such that the platform moves the magazine or the plurality of drones from the mobile unit to at least one wellhead.

Embodiments of the disclosure may be further directed to a wellbore deployment system including a plurality of self-erecting launcher assembly. Each self-erecting launcher assembly of the plurality of self-erecting launcher assembly may be configured substantially as described hereinabove. According to an aspect, each self-erecting launcher assembly of the plurality of self-erecting launcher assembly includes mobile unit having a receptacle, and a magazine including a plurality of drones and positioned in the receptacle. A rail unit may be secured to the mobile unit. According to an aspect, the rail unit is movable between a closed position and an elevated position and a platform is secured to the rail unit. The platform may be movable in an upward direction and a downward direction along a length of the rail unit, such that the platform moves the magazine or the plurality of drones from the mobile unit to at least one wellhead. The wellbore deployment system further includes a control unit configured to manage functionality and operation of the plurality of self-erecting launcher assembly.

Further embodiments of the disclosure may be associated with a wellbore deployment system including a self-erecting launcher assembly. The self-erecting launcher assembly includes a mobile unit including a receptacle. A magazine may be positioned in the receptacle. According to an aspect, the magazine includes a plurality of drones. A rail unit is secured to the mobile unit, and is movable between a closed position and an elevated position. According to an aspect, a platform is secured to the rail unit and is movable in an upward direction and a downward direction along the length of the rail unit. A location adjuster is configured to move the self-erecting launcher assembly from a first wellhead to additional wellheads at a well site.

BRIEF DESCRIPTION OF THE SEVERAL VIEWS OF THE DRAWINGS

To easily identify the discussion of any particular element or act, the most significant digit or digits in a reference number refer to the figure number in which that element is first introduced.

Figure 1:
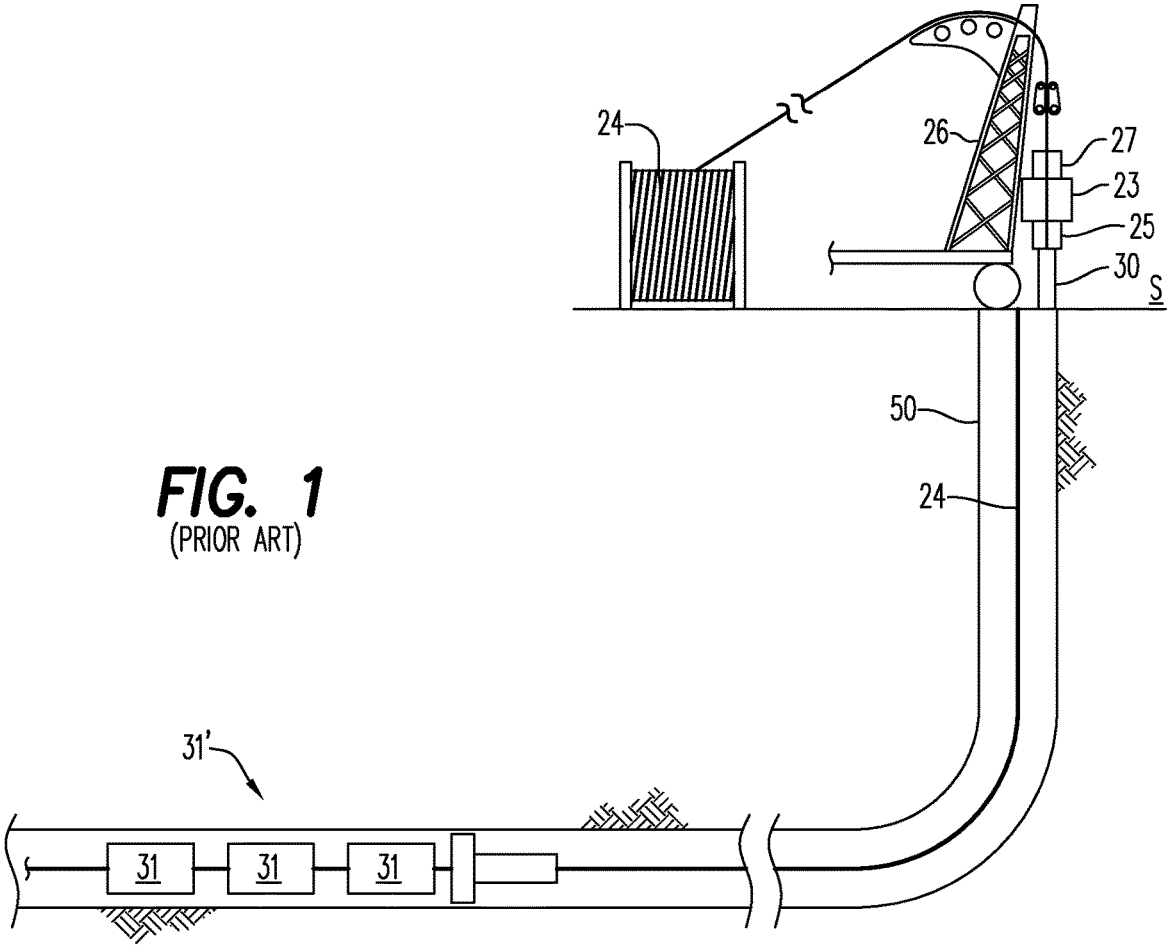
FIG. 1 (PRIOR ART)
FIG. 1 illustrates a wellbore deployment system, according to the prior art.

Various features, aspects, and advantages of the exemplary embodiments will become more apparent from the following detailed description, along with the accompanying drawings in which like numerals represent like components throughout the figures and detailed description. The various described features are not necessarily drawn to scale in the drawings but are drawn to emphasize specific features relevant to some embodiments.

The headings used herein are for organizational purposes only and are not meant to limit the scope of the disclosure or the claims. To facilitate understanding, reference numerals have been used, where possible, to designate like elements common to the figures.

DETAILED DESCRIPTION

Reference will now be made in detail to various embodiments. Each example is provided by way of explanation and is not meant as a limitation and does not constitute a definition of all possible embodiments.

Embodiments of the disclosure are associated with, among other things, a self-erecting launcher assembly 300/a drone delivery system/an autonomous tool delivery system. In an exemplary embodiment, the autonomous tool may be, without limitation, a drone. For purposes of this disclosure, a "drone" is a self-contained, autonomous or semi-autonomous vehicle for downhole delivery of a wellbore tool. For purposes of this disclosure and without limitation, "autonomous" means without a physical connection or manual control (such as a wireline). The assembly presented is versatile and facilitates the delivery of autonomous tools to a single well or multiple wells and facilitates a simplified and accurate mode of delivering such drones to a wellhead 950.

For purposes of illustrating features of the embodiments, embodiments of the disclosure will now be introduced in reference to the figures. Those skilled in the art will recognize that this example is illustrative and not limiting and is provided purely for explanatory purposes.

This application incorporates by reference each of the following pending patent applications in their entireties: U.S. Provisional Patent Application No. 62/842,329, filed May 2, 2019; U.S. Provisional Patent Application No. 62/841,382, filed May 1, 2019; International Patent Application No. PCT/IB2019/000526, filed Apr. 12, 2019; U.S. Provisional Patent Application No. 62/831,215, filed Apr. 9, 2019; International Patent Application No. PCT/IB2019/000530, filed Mar. 29, 2019; U.S. Provisional Patent Application No. 62/832,737, filed Mar. 26, 2019; International Patent Application No. PCT/IB2019/000537, filed Mar. 18, 2019; U.S. Provisional Patent Application No. 62/816,649, filed Mar. 11, 2019; U.S. Provisional Patent Application No. 62/720,638, filed Aug. 21, 2018; U.S. Provisional Patent Application No. 62/765,185, filed Aug. 16, 2016; U.S. Provisional Patent Application No. 62/719,816, filed Aug. 20, 2018; U.S. Provisional Patent Application No. 62/690,314, filed Jun. 26, 2018; U.S. Provisional Patent Application No. 62/678,654, filed May 31, 2018; and U.S. Provisional Patent Application No. 62/678,636, filed May 31, 2018.

In general, the embodiments of the disclosure concern the use of one or more drones in drilling and, especially, well completion operations. As used herein, the term "drone" refers to a downhole tool or toolstring not connected to a physical wire/cable, i.e., the term "drone" refers generally to an untethered downhole tool. Drones are configured for deployment into and use in a wellbore. The drone may be configured to move at pump speed or flow rate speed (i.e., the speed at which fluid is pumped into the wellbore).

Figure 2:
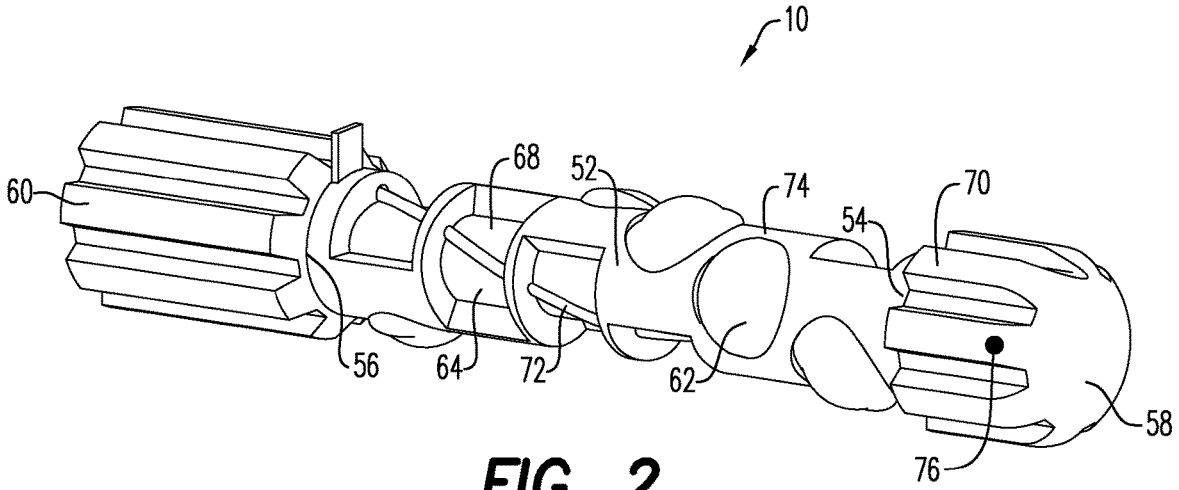
FIG. 2 illustrates a drone, according to the prior art.

With reference to FIG. 2, an exemplary embodiment of a drone 10 is shown. As described herein, the drone 10 may include a wellbore tool and may be launched autonomously or semi-autonomously into the wellbore 50. The wellbore tools may include, for example and without limitation, a perforating gun, puncher gun, logging tool, jet cutter, plug, frac plug, bridge plug, setting tool, self-setting bridge plug, self-setting frac plug, mapping/positioning/orientating tool, bailer/dump bailer tool and ballistic tool. The wellbore tool drones 10 are deployed in the wellbore 50, without requiring a wireline assembly.

The exemplary drone 10 shown in FIG. 2 is in the configuration of a downhole tool often referred to as a perforating gun. This perforating gun drone includes a body portion 52 having a front end 54 and a rear end 56. A head portion 58 extends from the front end 54 of the body portion 52 and a tail portion 60 extends from the rear end 56 of the body portion 52 in a direction opposite the head portion 58. The body portion 52 includes a plurality of shaped charge apertures 74 and open apertures 64. Each of the plurality of shaped charge apertures 74 are configured for receiving and retaining a shaped charge 62.

In the exemplary perforating gun drone embodiment, the body portion 52 is a unitary structure that may be formed from an injection-molded material, as are the head portion 58 and the tail portion 60. In other embodiments, the body portion 52, the head portion 58 and the tail portion 60 may constitute modular components or connections. As shown in FIG. 2, each of the body portion 52, the head portion 58 and the tail portion 60 is substantially cylindrically-shaped and may include fins 70. Each of these features is configured with regard to its travel as a drone 10 into the wellbore 50.

Figure 3A:
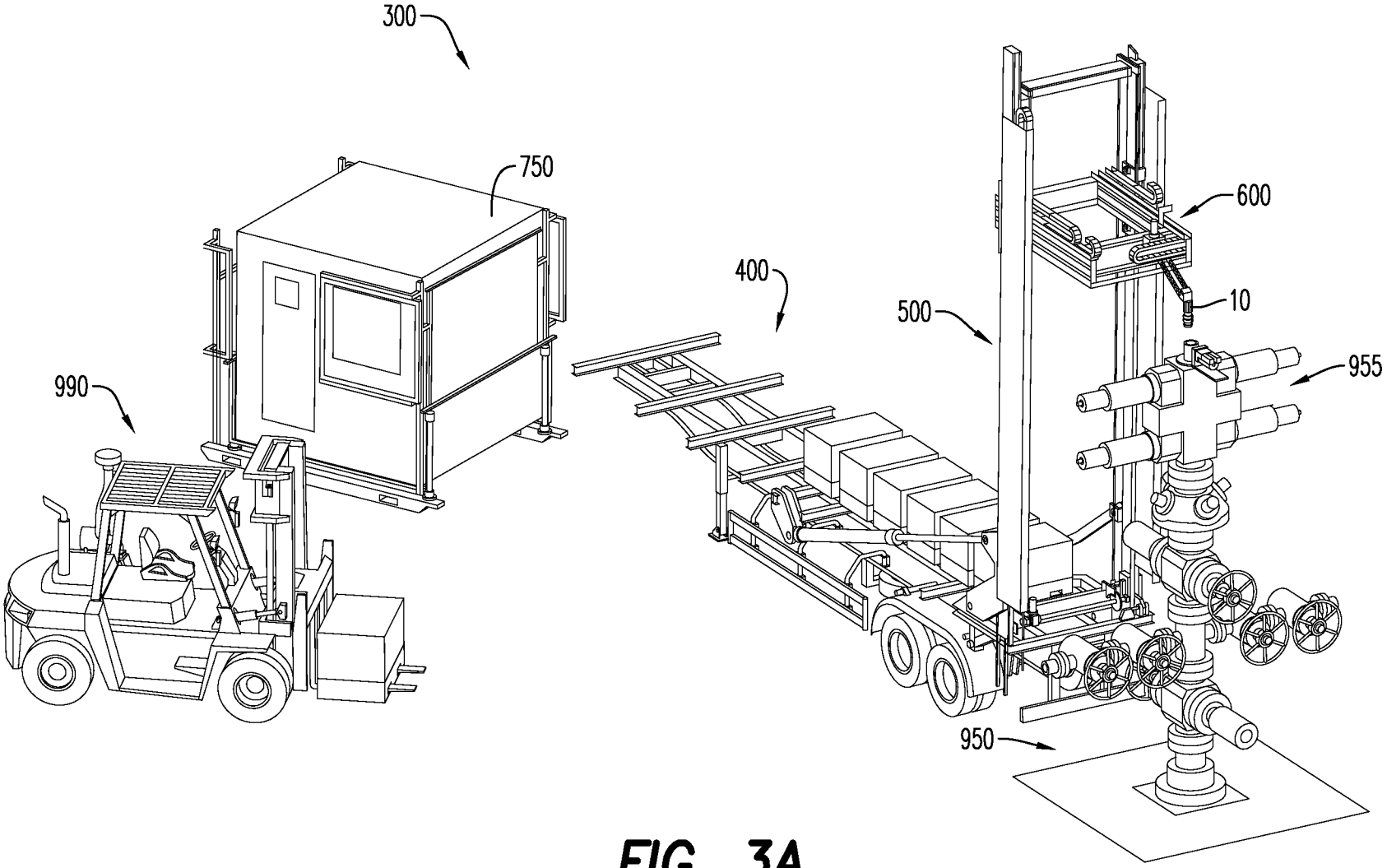
FIG. 3A illustrates a perspective view of a self-erecting launcher assembly, according to an aspect.
Figure 3B:
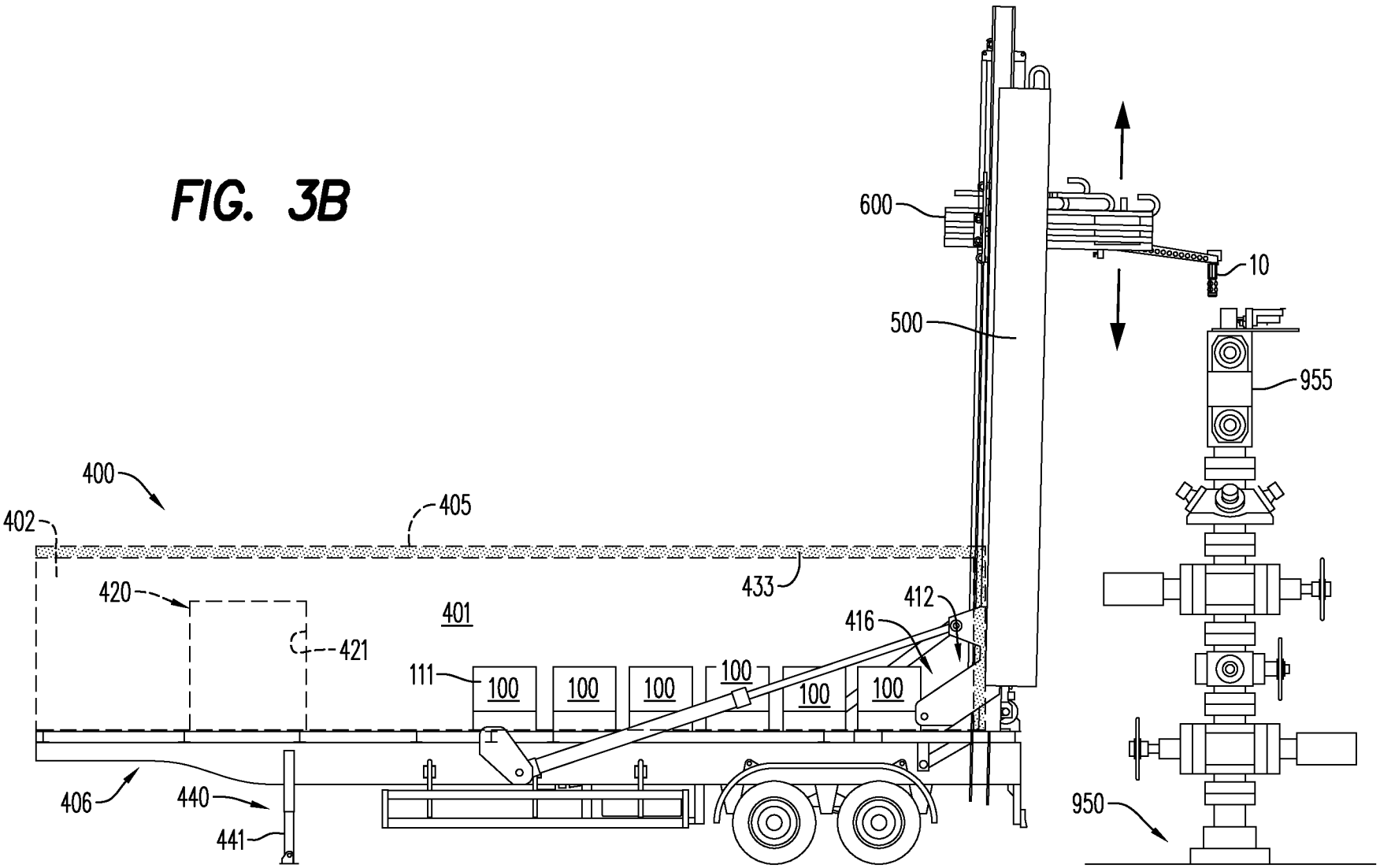
FIG. 3B illustrates a side view of the self-erecting launcher assembly of FIG. 3A.

Turning now to FIG. 3A and FIG. 3B, a self-erecting launcher assembly 300 is illustrated. The self-erecting launcher assembly 300 maybe configured to convey a drone 10 into a wellbore. According to an aspect and as described in further detail hereinbelow, the self-erecting launcher assembly 300 is configured to convey a plurality of drones into a plurality of wellbores. The self-erecting launcher assembly 300 includes a mobile unit 400, a rail unit 500 coupled to the mobile unit 400, and a platform 600 secured to the rail unit 500 and movable in an upward direction and a downward direction along a length of the rail unit 500.

Figure 4:
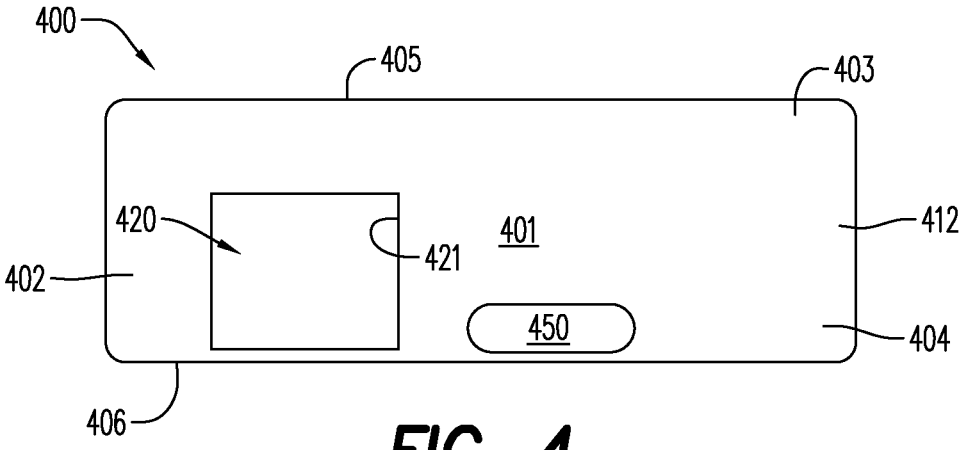
FIG. 4 illustrates a side view of a mobile unit including a magazine loading bay positioned in at least one side wall of the mobile unit, according to an aspect.

As seen in FIG. 4, the mobile unit 400 includes a receptacle 401. The mobile unit 400 further includes at least one side wall 402 having an upper portion 403 and a lower portion 404, a roof 405 connected to the upper portion of the at least one side wall, and a floor 406 connected to the lower portion 404 of the at least one side wall 402. The receptacle 401 may be bounded by the at least one side wall 402, the floor 406 and the roof 405. According to an aspect, the mobile unit 400 is configured as a truck or a portion of a truck, such as a flatbed, a c-bed or a box unit of a trailer. The mobile unit 400 may include a stabilizer unit 440, described in further detail hereinbelow, to secure the mobile unit 400 in place. Alternatively, or in combination with the stabilizer unit 440, the mobile unit 400 may include a plurality of wheels 410 that allows the mobile unit 400 to move between different locations, such as between a plurality of wellheads 950.

The mobile unit 400 may include a hydraulic unit 450 to power one or more components of the self-erecting launcher assembly 300. The hydraulic unit 450 may be a self-contained system. According to an aspect the hydraulic unit 450 includes a motor, a receptacle including hydraulic fluid, and a pump. One or more filters are provided to prevent contaminants such as dust and dirt from the well site from entering the receptacle of the hydraulic unit 450, thereby keeping the hydraulic fluid clean. The hydraulic unit 450 applies the hydraulic pressure in order to power the components of the self-erecting launcher assembly 300, such as hydraulic pistons in the telescoping elements 335 and any other mechanical elements required to erect the launcher assembly including the side rails 330 from the horizontal position into the vertical position.

Figure 5:
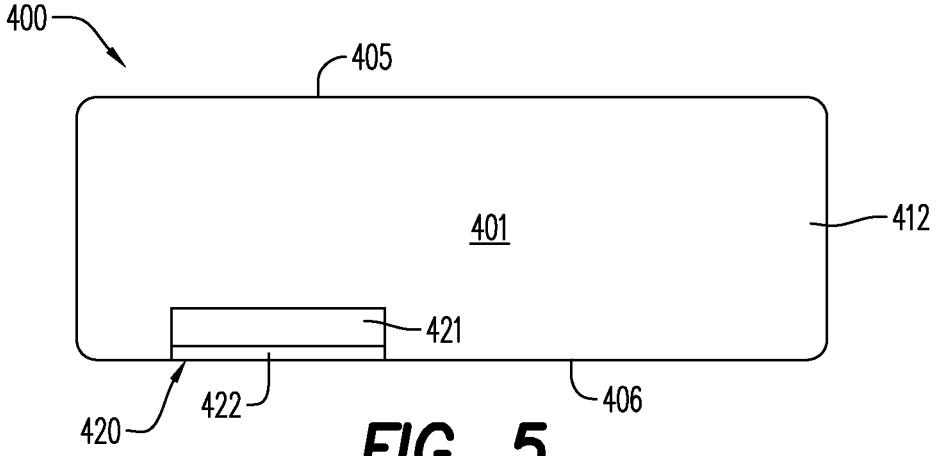
FIG. 5 illustrates a side view of a mobile unit including a magazine loading bay positioned in the floor of the mobile unit, according to an aspect.

According to an aspect and as illustrated in FIG. 4 and FIG. 5, the mobile unit 400 includes a magazine loading bay 420. The magazine loading bay 420 may be configured as an opening 421 that serves as a conduit between an area outside of the receptacle 401 and an area within the receptacle 401. The magazine loading bay 420 may be in communication with the receptacle 401, such that the receptacle 401 is accessible by a user through the magazine loading bay 420.

As illustrated in FIG. 4 the magazine loading bay 420 may be positioned in the at least one side wall 402 of the mobile unit 400. When the magazine loading bay 420 is configured as an opening 421, a door or covering member (not shown) may be provided over the opening 421. The door may be movable between open and closed positions to provide access to and to limit access to the receptacle 401. According to an aspect, the door may be connected to the side wall of the mobile unit 400 by hinges, such that the door can swings between the open and closed positions. The door may be configured as a drop door connected to the at least one side wall 402 by two or more hinge elements positioned along a bottom edge of the door.

Alternatively, and as illustrated in FIG. 5, the magazine loading bay 420 may be positioned in the floor 406 of the mobile unit 400. In this configuration, the magazine loading bay 420 may include a hatchway door 422. Alternatively, the door may be a sliding door. When the door is positioned in the floor 406 of the mobile unit 400, a lift mechanism (not shown) may be employed to move a magazine 100 into and out of the receptacle 401 of the mobile unit 400.

Figure 6:
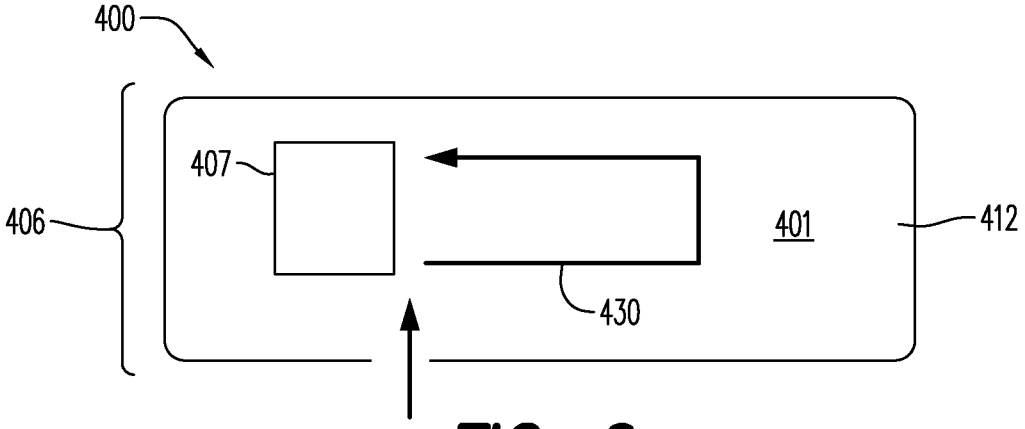
FIG. 6 illustrates the movement of a drone within a receptacle of a mobile unit, according to an aspect.

According to an aspect and as illustrated in FIG. 6, the mobile unit 400 further comprises a conveyor system 430. The conveyor system 430 is arranged in the receptacle 401 and is configured to move an object, such as a magazine or a drone 10 from the magazine loading bay 420 to a magazine retrieval zone 416 (see FIG. 7). According to an aspect, the conveyor system 430 includes a conveyor belts operable to transport a magazine 100 or a drone (positioned within or external to a magazine 100). The conveyor belts of the conveyor system 430 may be configured to transport a plurality of the magazines 100 and/or drones simultaneously. According to an aspect, the conveyor system 430 includes rollers to help reduce the friction between the magazines 100 or drones and the conveyor belt. As illustrated in FIG. 6, the conveyor system 430 may be arranged on a path where the magazines 100 or drones travel along the path independent of each another. One or more conveyor platforms (not shown) may be positioned on the conveyor belt in order to serve as a designated surface upon which the magazines 100 and drones can be positioned. The conveyor system 430 and empty or rejected magazines 100 are moved to the back of the mobile unit 400 via the same loop. An alternate magazine 100 return technique may include lowering a magazine 100 through a hatch door or opening 407 formed in the floor 406 of the mobile unit 400.

Figure 7:
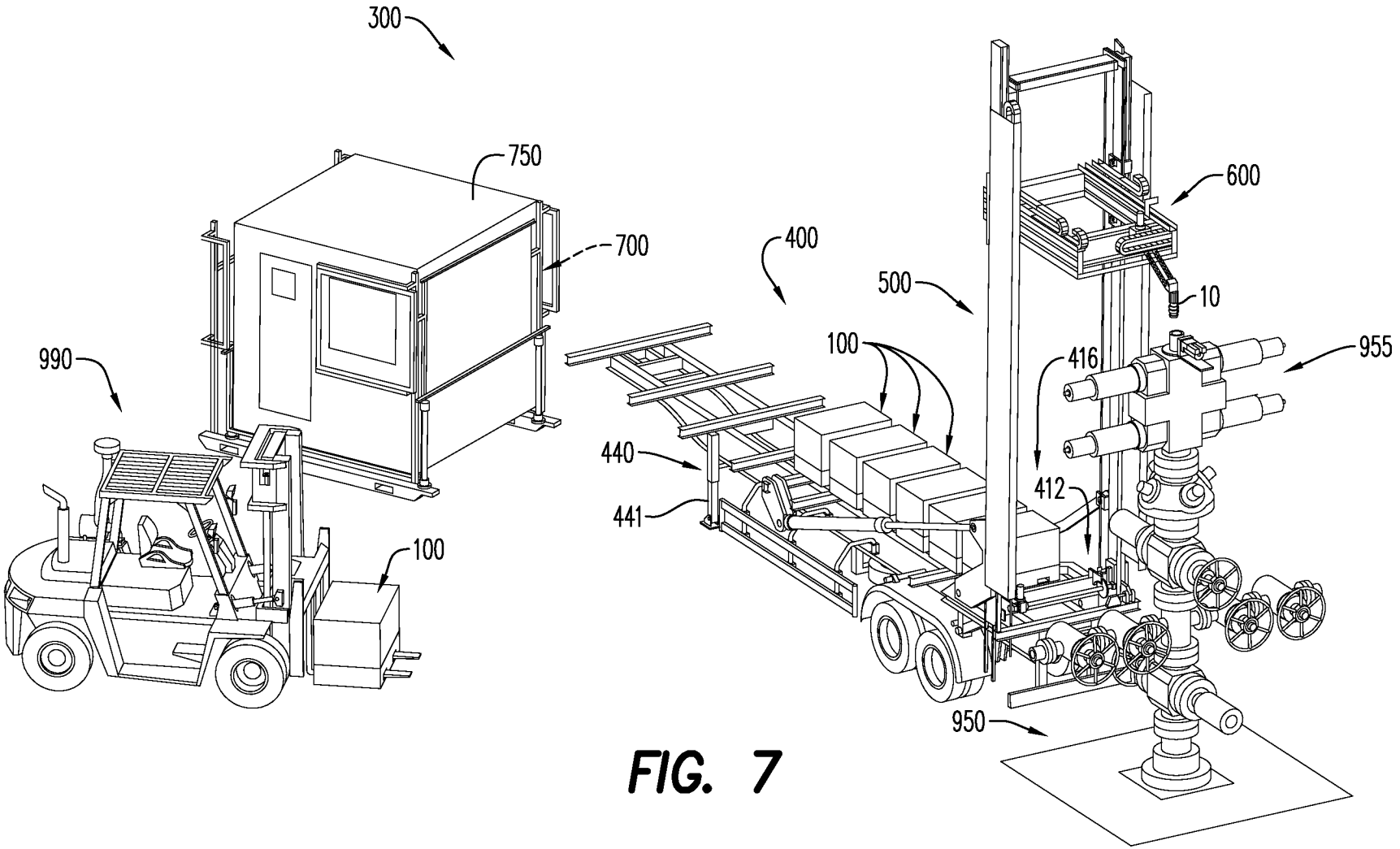
FIG. 7 illustrates a top view of a self-erecting launcher assembly, according to an aspect.

When the magazines 100 are loaded into the receptacle 401 of the mobile unit 400 through the magazine loading bay 420, they are moved internally via, for example, by the conveyor system 430 to the front portion 412 of the mobile unit 400. As illustrated in FIG. 7, the magazine retrieval zone 416 may be positioned at the front portion 412 of the mobile unit 400.

Once a magazine 100 is in the front portion 412 of the mobile, drones are charged (electrically) within the magazine 100 from a power source. Because the drone may include an explosive component, in order to reduce or inhibit the potential impact of inadvertent detonation of the explosive component of the drone 10, one or more surfaces of the mobile unit 400 may include a metal foam 433. According to an aspect, the front of the receptacle 401 is specially shielded against internal blast by the metal foam 433. In some embodiments, the metal foam 433 includes at least one of aluminum, steel, iron, or combinations thereof. The metal foam 433 may line an inner surface of the upper portion 403 of the mobile unit 400. According to an aspect, the metal foam 433 may line the inner surface of at least one of the side walls, the roof 405 and the floor 406 of the mobile unit 400. The metal foam 433 may be composed of various metal alloys. In some embodiments, the metal foam 433 is a porous irregular structure and may be formed from various methods, including gas injection within a metallic structure, powder metallurgy, casting, metallic deposition, sputter deposition, and/or heat treatment of aluminum powder. The metal foam 433 may be bonded together with sheet metal composed of various metal alloys, such as steel. The metal foam 433 prevents and/or limits ballistic transfer from one drone/autonomous wellbore device to another drone or autonomous wellbore device in the event of detonation of an explosive component of the drone or autonomous wellbore device.

As described herein, the magazines 100 may contain one or more drones for delivery into the wellbore. For purposes of the disclosure, exemplary embodiments of a launcher assembly and delivery system are described for brevity for use with a drone, although the disclosure is not limited thereto and the launcher assembly/delivery system is not limited to use with any particular wellbore tool(s).

The magazine contemplated for use with the self-erecting launcher assembly 300 may be configures substantially as the magazine described in US Publication No. US 2020/0332618, which is commonly-owned and assigned to DynaEnergetics Europe GmbH, the disclosure of which is incorporated herein by references in its entirety.

According to an aspect, the magazine 100 includes a magazine frame serving the function of holding the plurality of drones. The magazine frame may be divided into multiple sections. For example, first section of the magazine frame may hold a first group of drones and second section of the magazine 100 frame may hold a second group of drones. In addition, other multi-segment magazine 100 frames may hold other groups of drones. Each group of drones may, whether occupying a single magazine 100 or multiple magazines, comprise a single tool. That is, tools having different functions may be selected from one or more magazines and dropped into the wellbore 50 in a predetermined and useful order. Alternatively, different groups of drones may be the same tool but with configuration details varying from group to group. Tools with a particular configuration may be placed in the wellbore 50 in a predetermined and useful order. In another embodiment, a magazine 100 may be loaded with drones of different types or configurations in the order in which it is desired to drop the drones into the wellbore. In this case, switching magazines is unnecessary except to the extent that a magazine 100 has been exhausted of drones 10.

The magazine 100 may also include at least one magazine transceiver configured to communicate with the drone 10. According to an embodiment, the at least one magazine transceiver is received within each of the magazine chambers. Alternatively, a single magazine transceiver is provided with each magazine 100 and relays information regarding the drones 10. The magazine transceiver may receive information transmitted from a communication with a drone transceiver included in the drone 10. According to an aspect, the drone transceiver may be as simple as a radio-frequency identification (RFID) tag, an optical marker such as a QR code or bar code or a data matrix code. It is contemplated that the magazine transceiver may communicate with one or more transceivers included in the drone 10.

In an embodiment, the magazine transceiver receives information from a plurality of sensors. The sensors may be configured to perform at least one of a plurality of functions. According to an aspect, the sensors are configured to detect the presence of the drone 10 in the magazine chamber. If the sensor in one of the magazine chambers determines that no drone 10 is present, the release element corresponding with that magazine chamber will remain in its closed position.

According to an aspect, the sensors may distinguish between different types of drone 10. This may be particularly important when selecting the type of drone 10 that should be dispensed from the magazine 100. The sensors may be configured to measure a voltage level of a battery housed within the drone 10.

Figure 15:
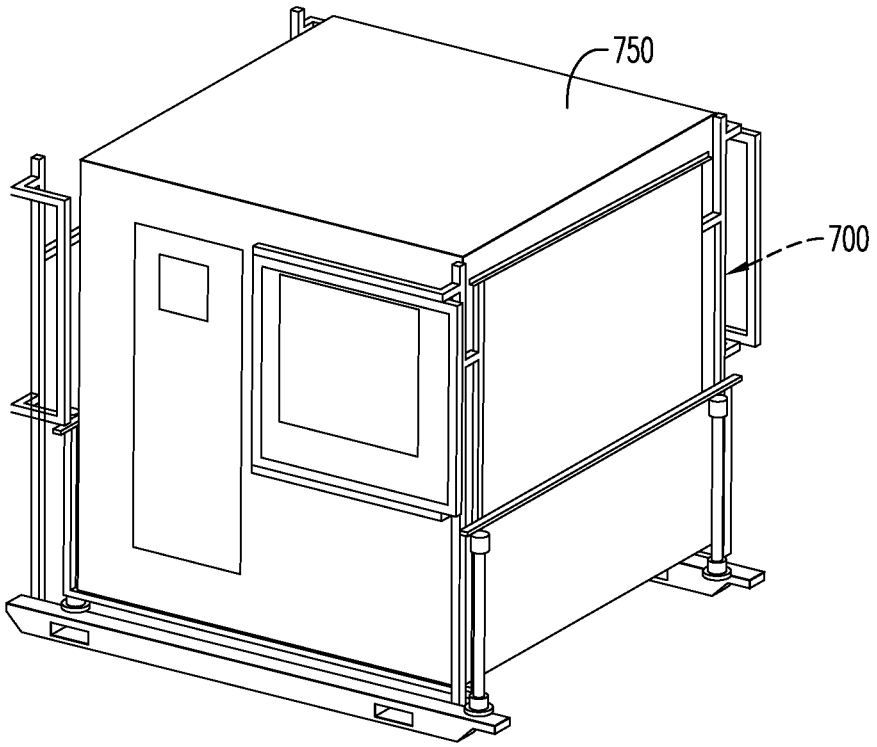
FIG. 15 illustrates a perspective view of a control unit of a self-erecting launcher assembly, according to an aspect.
Figure 16:
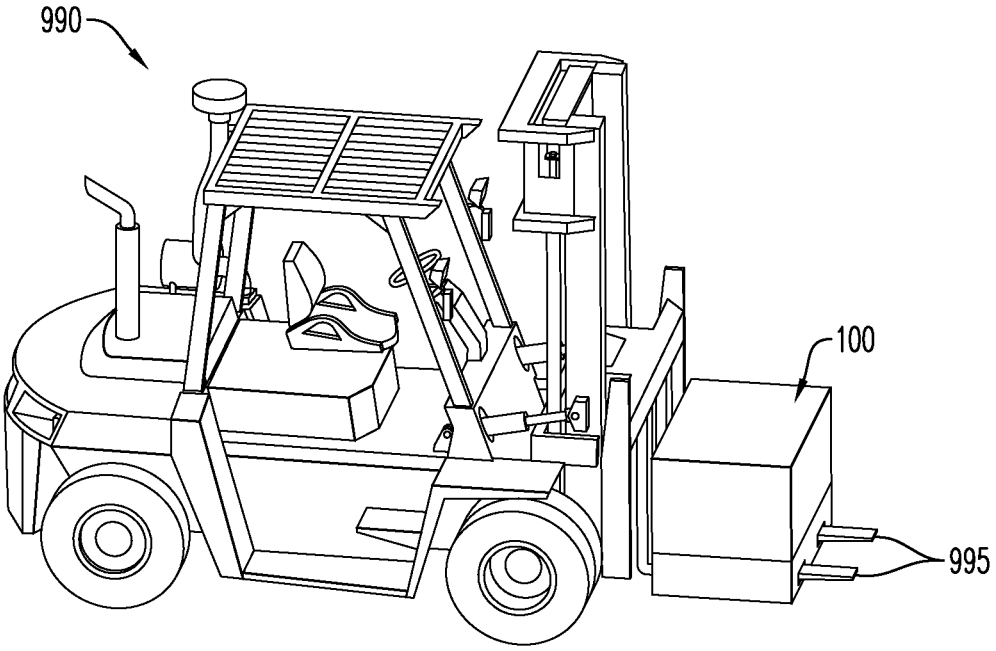
FIG. 16 illustrates a perspective view of a device for delivering a magazine to a mobile unit, according to an aspect.

In an embodiment, the magazine 100 is configured to perform one or more self-tests in response to a command from a control unit 700 (see FIG. 15). The control unit 700 may be electrically connected to one or more of the magazines 100, the magazine chambers and the drone 10 by one of a wireless local area network (LAN) connection, a wireless connection such as through a Bluetooth, and a plug-in adapter connection. According to an aspect, each of the magazine chambers is automatically locked in place based on the information received by the magazine transceiver or the results of the one or more tests.

The magazine chambers may also include one or more safety device actuators. According to an aspect, the one or more safety device actuators may include a ballistic limiter 111 configured to prevent or limit ballistic transfer from a first drone to a second drone positioned in the magazine 100 in the event of detonation of an explosive component of the first drone. The ballistic limiter 111 may include metal foam, configured substantially as described hereinabove.

As illustrated in FIG. 7, at least one stabilizer unit 440 may be positioned on a lower portion 404 of the mobile unit 400. The at least one stabilizer unit 440 may help withstand the weight and operation of the magazines 100, and other components described in further detail hereinbelow (such as rails, a platform 600, and motor used with the self-erecting launcher assembly 300). The at least one stabilizer unit 440 may include a generally U-shaped bar along the floor 406 of the mobile unit 400 connected to plurality of wheels 410. According to an aspect, a plurality of stabilizer units may be provided, with a first stabilizer unit being positioned at the front portion 412 of the mobile unit 400 and a second stabilizer unit being positioned at a rear portion of the mobile unit 400.

According to an aspect, the at least one stabilizer unit 440 includes at least one stabilizer bar 441 extending vertically from the lower portion of the at least one side wall to a ground surface. A pair of spaced-apart vertically extending stabilizer bars may be provided, each stabilizer bar being spaced apart from another stabilizer bar. The vertically extending stabilizer bars may each extend between the lower portion of the at least one side wall to the ground surface. According to an aspect, a horizontal stabilizer bar/cross bar (not shown) may extend along the floor 406 portion of the mobile unit 400, with each end of the horizontal stabilizer bar being connected to a vertically extending stabilizer bar that extends to the ground surface.

Figure 8:
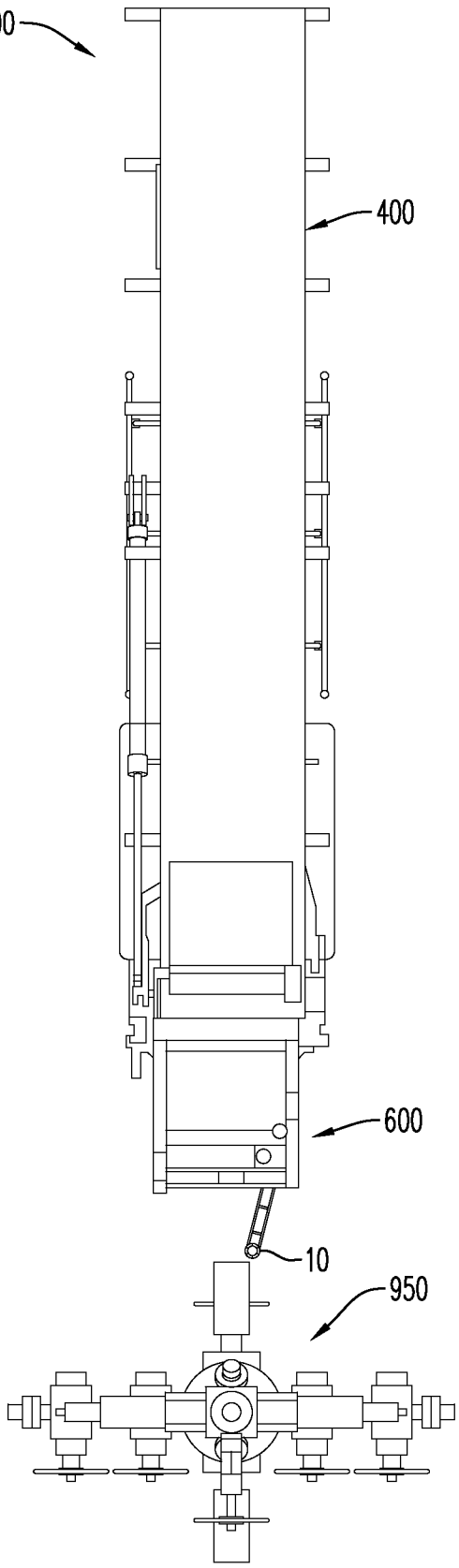
FIG. 8 illustrates a top view of a mobile unit positioned on a rail unit, according to an aspect.

While FIG. 8 illustrates the self-erecting launcher assembly 300 being positioned to service a single wellbore 50 or a single wellhead 950, it is contemplated that the mobile unit 400 may be movable between a plurality of wellheads 950.

The self-erecting launcher assembly 300 may be configured to may serve multiple wells. According to an aspect, and as illustrated in FIG. 3, the mobile unit 400 may include a plurality of wheels 410 that allows the mobile unit 400 to move between different locations, e.g., by towing, such as between a plurality of wellheads 950.

Figure 9:
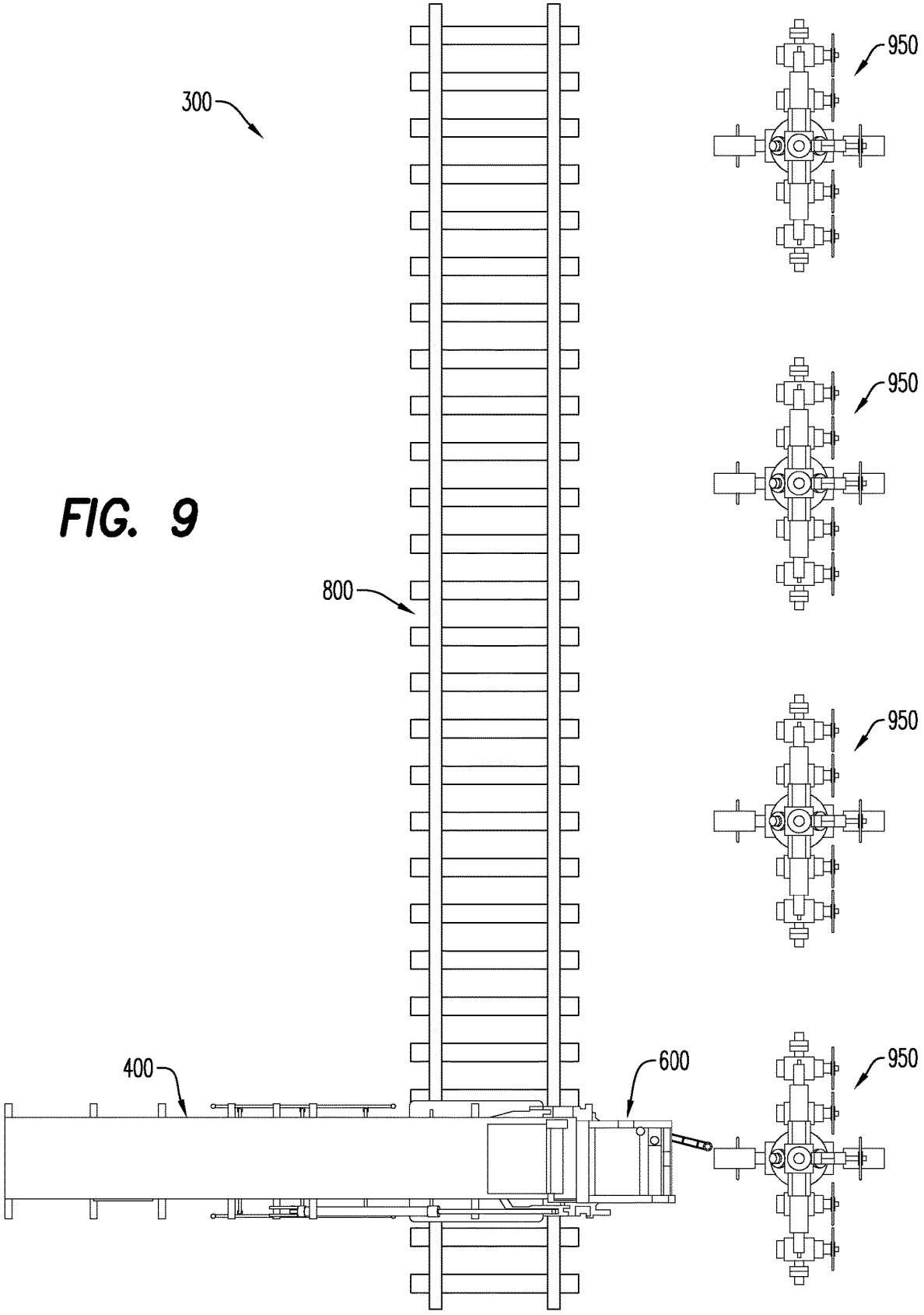
FIG. 9 illustrates a a top view of a mobile unit of a self-erecting launcher assembly, configured to service a plurality of wellheads, according to an aspect.

Alternatively, and as illustrated in FIG. 9, the mobile unit 400 is positioned to travel on a track rail 800 secured to a ground surface, such that the mobile unit 400 can access and service multiple wellheads 950. The track rail 800 may include a track section including one or more moving elements arranged to travel along the track section. According to an aspect, the track rail 800 includes a plurality of track segments that are modular. The track rail segments may be connected, and quickly and easily disconnected or separated from one another. According to an aspect, the track rail segments may be connected to form a long track rail so that the plurality of wellheads 950 may be accessible by the mobile unit 400. According to an aspect, the track segments may be mounted on an elevated support (not shown) so that the track segments are spaced apart from the ground surface.

According to an aspect, a location sensor or detector (not shown) may be positioned on the track rail segments. The location sensor may be positioned on the mobile unit 400. The location sensor may be disposed on the track rail segments or on the mobile unit 400 such that a location of the mobile unit 400 unit may be easily determined.

Figure 10:
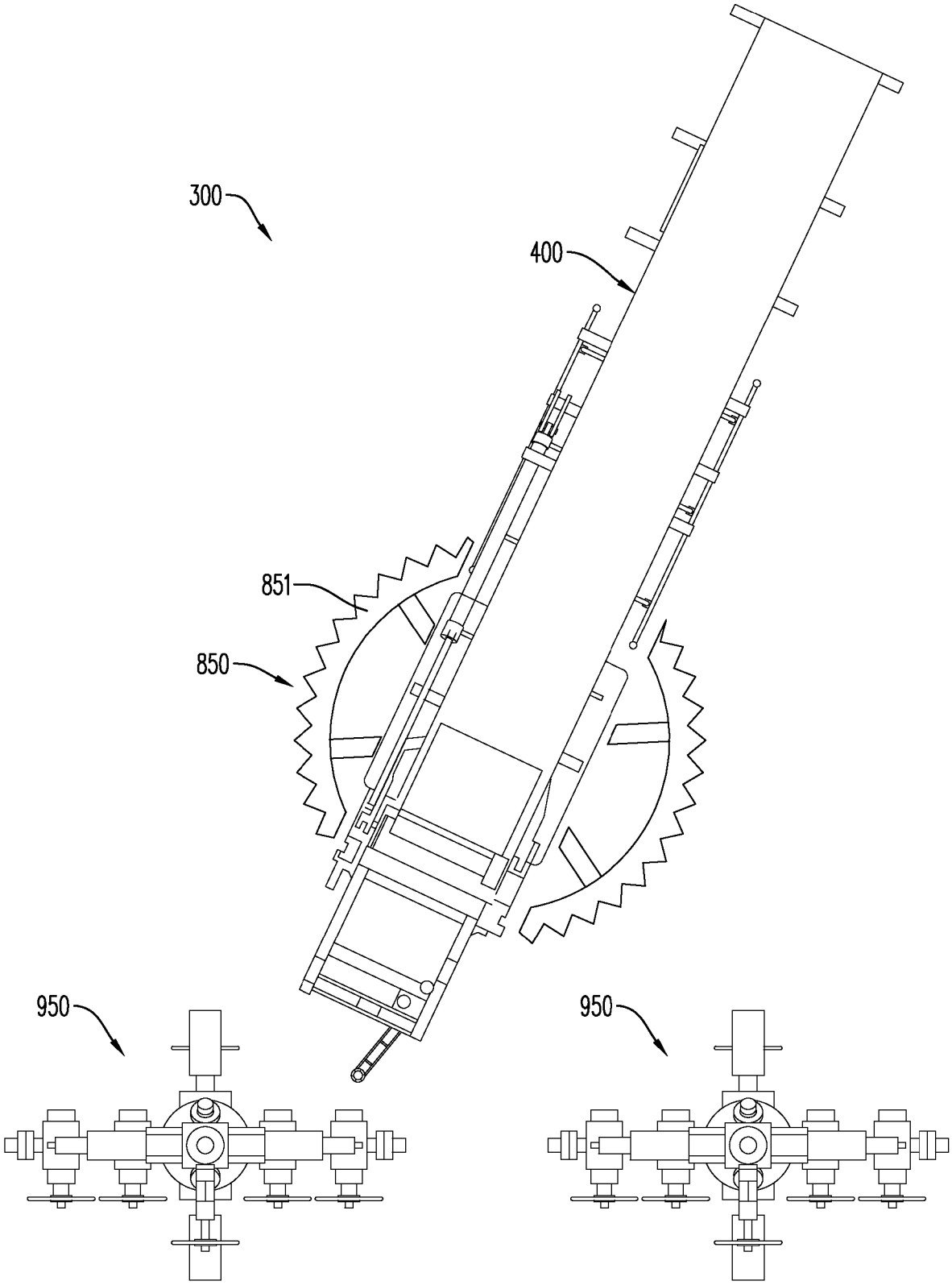
FIG. 10 illustrates a top view of a mobile unit 400 of a self-erecting launcher assembly 300 positioned on a rotational unit, according to an aspect.

In an embodiment and as illustrated in FIG. 10, the mobile unit 400 can be installed on a rotational unit 850 that allows the self-erecting launcher assembly 300 to service multiple wellheads 950. The rotational unit 850 includes a rotatable base 851 upon which the mobile unit 400 is positioned. According to an aspect, the rotatable base 851 is rotatable 360-degrees so that the front portion 412 of the mobile unit 400 can be positioned so that the magazine retrieval zone 416 is adjacent a wellhead 950. As illustrated in FIG. 10, the mobile unit 400 may rotate between a first wellhead 950 and a second wellhead 950.

In aspects/alternative arrangements of the exemplary embodiments, the mobile unit 400 may be elevated directly on a scissor lift (not shown) or the like for elevating the mobile unit 400 to a portion or full height of the wellhead 950 or lubricator 955. This may, for example, reduce or eliminate the time required for a platform 600, including a drone delivery arm, to travel up and down between the receptacle 401 and the top of the wellhead 950 or lubricator 955.

Figure 11:
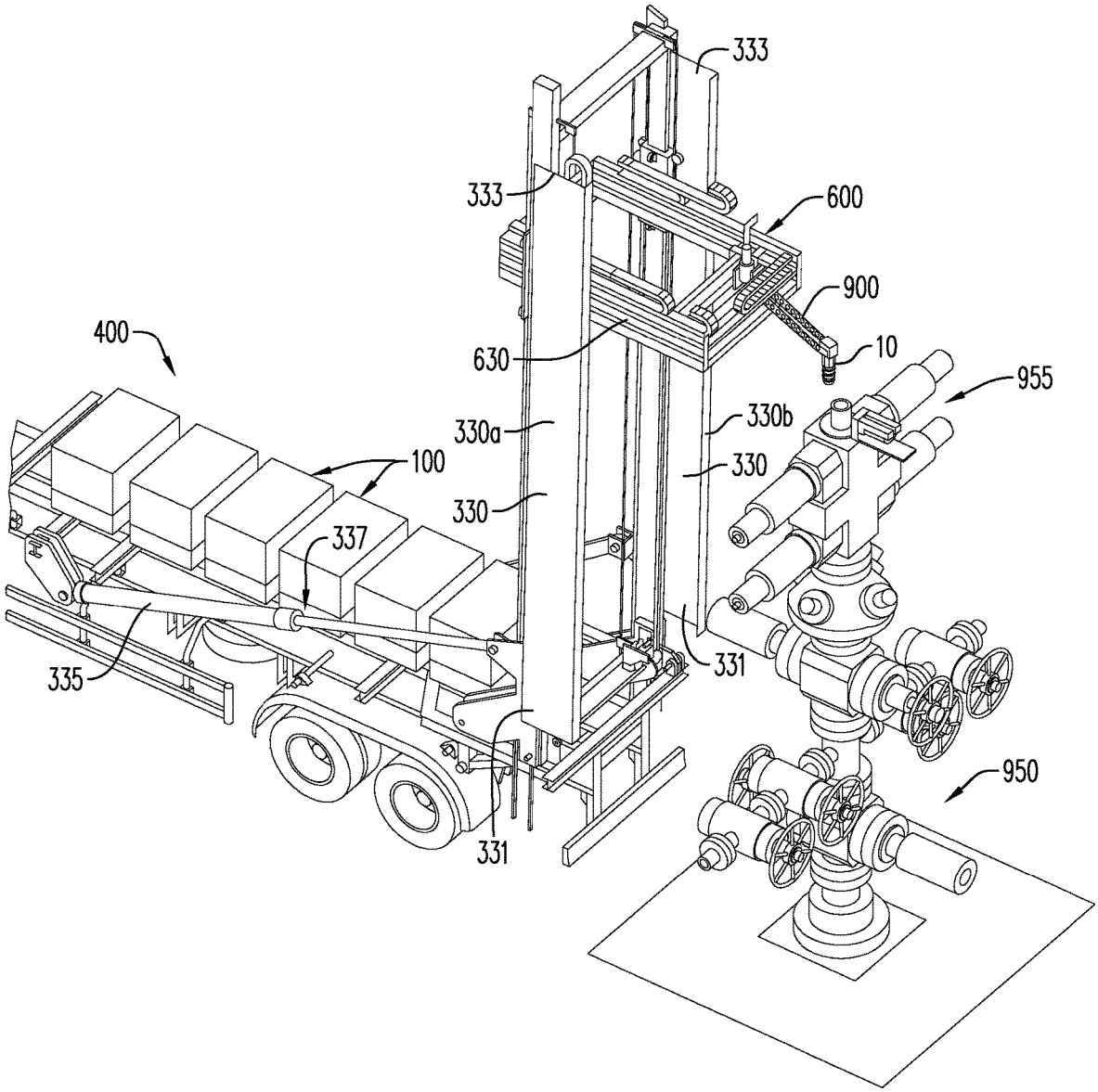
FIG. 11 illustrates a side, perspective view of a rail unit in an elevated position and a platform secured to the rail unit and positioned to deploy a drone in a wellhead, according to an aspect.
Figure 12:
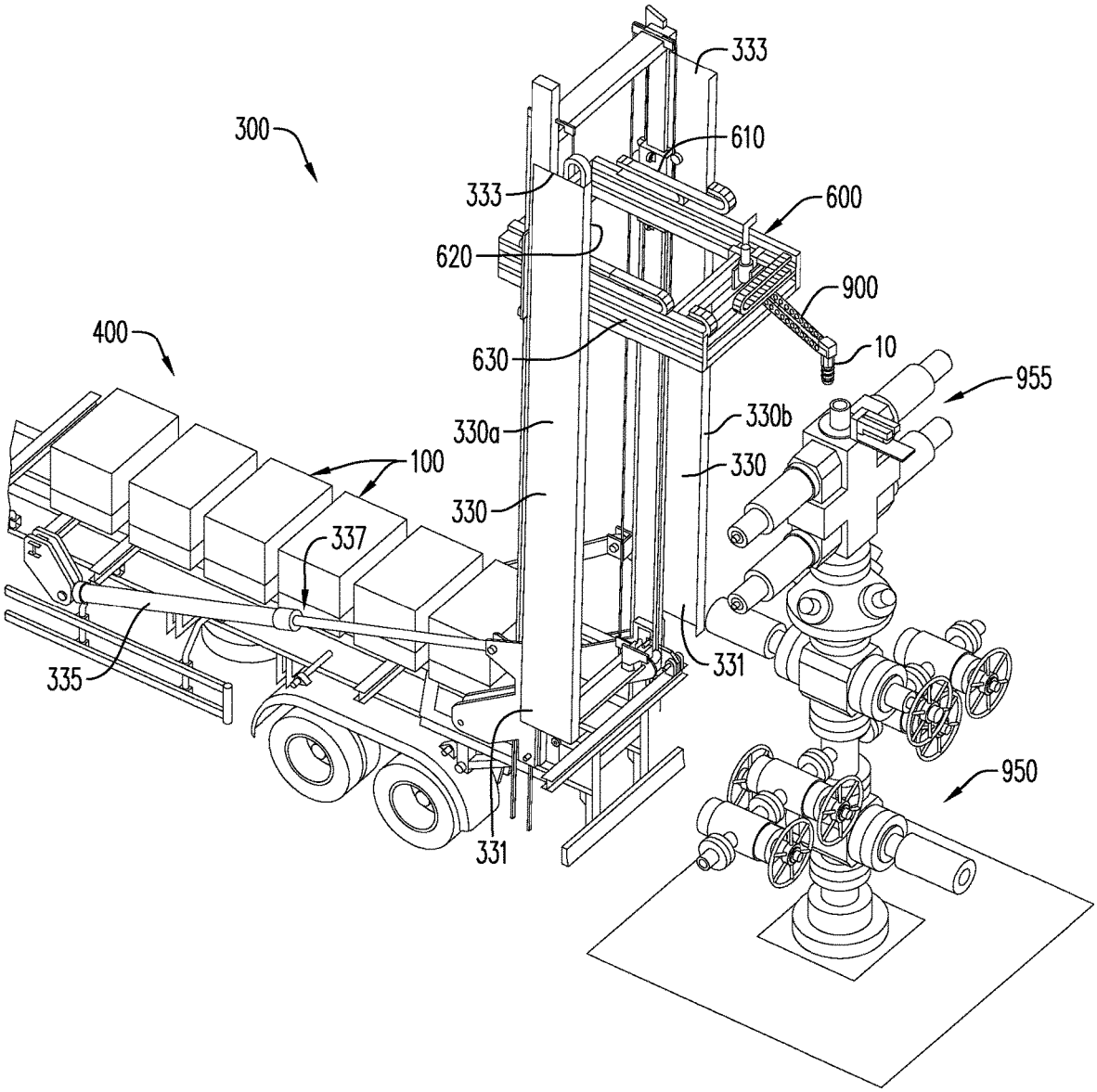
FIG. 12 illustrates a top view of the platform of FIG. 11.

As illustrated in FIG. 11 and FIG. 12, the self-erecting launcher assembly 300 may include a pair of spaced apart side rails 330 that are movable between a closed (non-erected) position and an open (erected or open) position. The pair of spaced apart side rails 330 may be connected to the mobile unit 400 by a hinge connection. Each side rail of the pair of spaced apart side rails 330 includes a connected end 331 and a free end 333. According to an aspect, a telescoping element 335 extends between the connected end 331 and the free end 333, and the mobile unit 400. According to an aspect, the telescoping element 335 includes a pair of telescoping arms (not shown). A first telescoping arm 337 of the pair of telescoping arms may be configured to move a first rail 330*a* of the pair of spaced apart side rails 330, and a second telescoping arm (not shown) of the pair of telescoping arms 336 may be configured to move a second rail 330*b* of the pair of spaced apart side rails 330. The first telescoping arm 337 is connected to the first rail 330*a* at an intermediate position between the first end and the second end of the first rail 330*a*. The second telescoping arm is connected to the second rail 330*b* at an intermediate position between the first end and the second end of the second rail 330*b*. The rails may be raised from the mobile unit 400, via the first telescoping arm 337 and the second telescoping arm.

When in their fully erected positioned, the first and second side rails 330*a*, 330*b* may be positioned at about a 90-degree angle. This may help to enhance the stability of the self-erecting launcher assembly 300 so that it remains secure to the ground surface. According to an aspect, the pair of spaced apart side rails 330 may be detachable from the mobile unit 400 (not shown). In its detached configuration, the pair of spaced apart side rails 330 may move between multiple wellheads 950.

A platform 600 may be positioned between and slidably connected to each rail of the pair of spaced apart side rails 330. According to an aspect, the platform 600 includes a right side connector 610 connected to the first rail and a left side connector 620 connected to the second rail 330*b*. The right side connector 610 includes a protrusion (not shown) that is received in a groove formed in the first rail 330*a* and the left side connector 620 includes a protrusion that is received in a groove formed in the second rail 330*b*. The right and left side connectors 610, 620 help to facilitate movement of the platform 600 along the rail unit 500, which helps to move drones from the mobile unit 400 to the wellhead 950. The platform 600 slides up and down the rail (when positioned at the 90-degree angle) to retrieve drone(s) and elevate them to the height of a lubricator 955 at the top of the wellhead 950. According to an aspect, the platform 600 may retrieve a magazine 100 from the mobile unit 400 and move the magazine 100 up the rail. Once the magazine is oriented so that it is above or close to the wellhead 950, drones may be moved from the magazine to the wellhead 950.

According to an aspect, the platform 600 may be a planar surface. According to an aspect, the platform 600 may include a platform bar 630 that connects to the pair of spaced apart side rails 330 and provide a surface for receiving and securing a "pick and place" manipulator arm 900 (described in further detail hereinbelow) to the platform 600. According to an aspect, the platform 600 may be configured such that an unrestricted 2-dimensional movement of the manipulator arm 900 in both axes of the horizontal plane is possible, thus enabling an effective and reliable placement of an armed drone to the lubricator.

Figure 13:
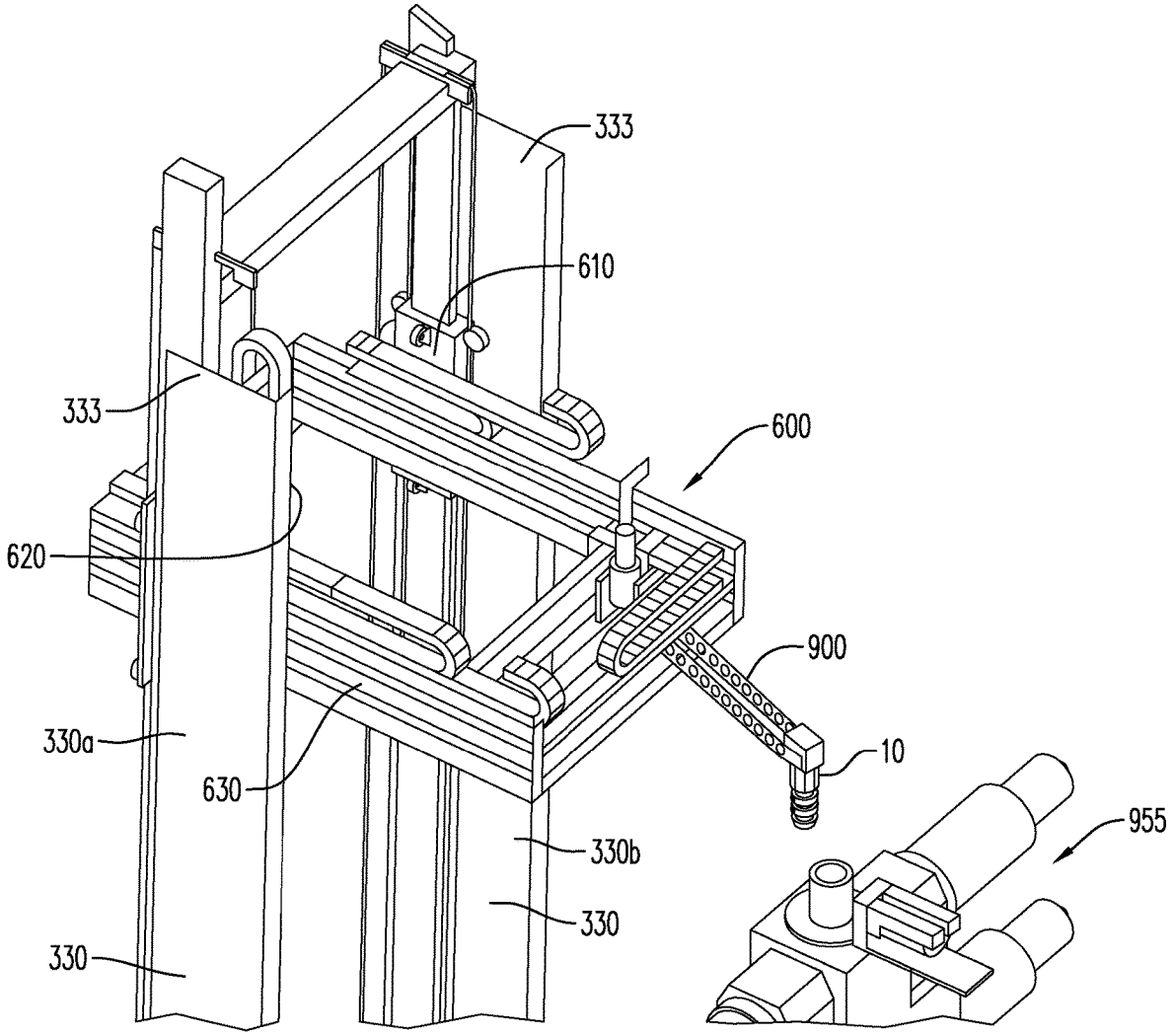
FIG. 13 illustrates a perspective view of the platform of FIG. 11, according to an aspect.
Figure 14:
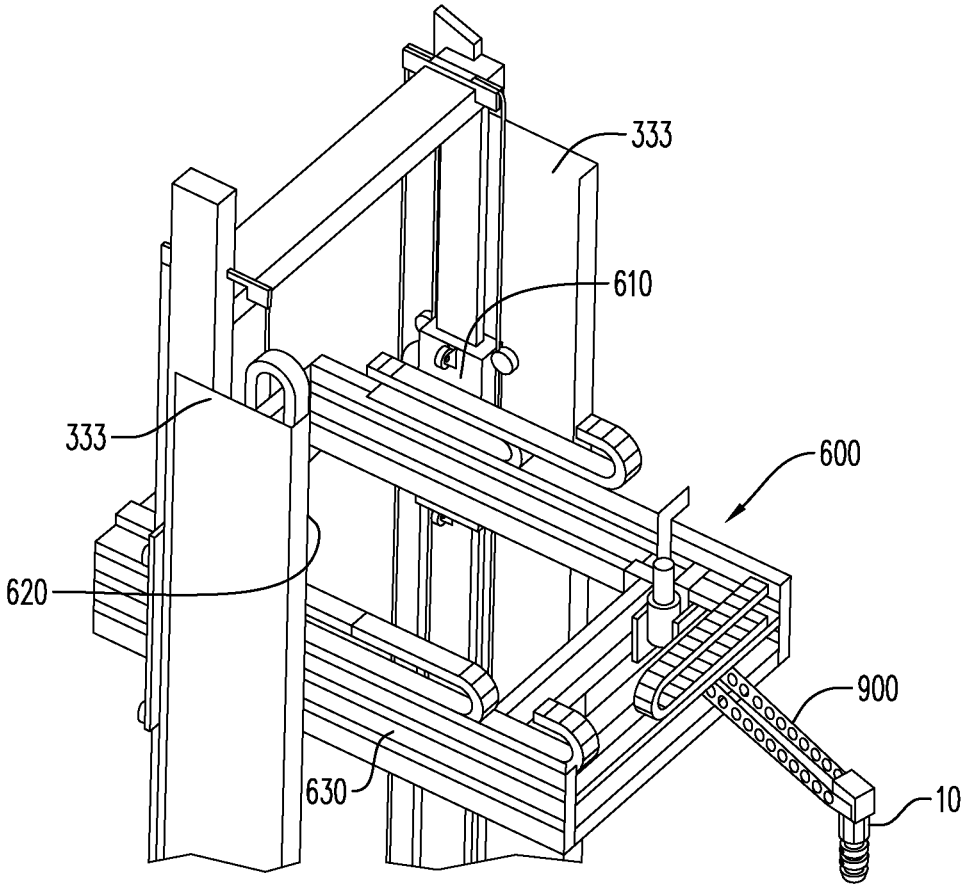
FIG. 14 illustrates a platform slidably positioned on a track rail, according to an aspect.

According to an aspect and as seen in FIG. 13 and FIG. 14 for example, a drone delivery pick-up and deployment arm, also referred to herein as a manipulator arm 900, is secured to the platform 600. The manipulator arm 900 may retrieve a single drone, or multiple drones at once, from the magazine 100 and deliver them one-by-one to the top of one or several wellheads 950 (in appropriate proximity to the self-erecting launcher assembly 300). The manipulator arm 900 may have a reach of any amount between about 1 meter to about 10 meters. According to an aspect, the manipulator arm 900 has a reach of about 3 meters to about 5 meters. While FIG. 13 and FIG. 14, for example, illustrate a single manipulator arm 900, it is contemplated that two or more manipulator arms 900 may be provided.

According to an aspect, the drone 10 may be charged once it is engaged with the manipulator arm 900. Once the drone 10 is charged, according to an aspect, the manipulator arm 900 may subject the drone 10 to pre-deployment testing to confirm that the drone 10 is programmed, charged, armed and tested, and will operate according to a given set of parameters. The parameters may be set to confirm that the drone 10 will operate as desired in the wellbore 50. The parameters may also be set to confirm that the drone selected is of the correct configuration sought to be next dropped into the wellbore 50. Electrical or signal connections associated with the manipulator arm 900 may perform this testing once the manipulator arm 900 engages the drone 10.

The programming of a drone 10, i.e., providing instructions to electronics inside the drone 10, may be accomplished either previous to or simultaneously with the pre-deployment testing. The details of the programming provided to a particular drone 10 will depend upon the type of drone it is and the details of the job to be performed.

The drone may include an activation pin, latch or ballistic interrupt (not shown) that prevents certain functions from occurring prior to the drone 10 being deployed in wellbore 50. The ballistic interrupt in an exemplary embodiment of a drone may be positioned to prevent detonation of shaped charges within a perforating drone, such as described in U.S. application Ser. No. 16/451,440 filed Jun. 25, 2019 and Ser. No. 16/542,890 filed Aug. 16, 2019, each of which are commonly owned by DynaEnergetics Europe GmbH. The mechanism for removing or moving the ballistic interrupt may be, without limitation, a hydraulically or electrically powered mechanical engagement for the ballistic interrupt.

For example, in the event that the drone 10 contains explosives or pyrotechnics, it is very important to prevent initiation of these elements prior to dropping the drone 10 into the wellbore. Removal of the ballistic interrupt may be performed by the manipulator arm 900 prior to disposal of the drone 10 into the wellbore 50. For example, once the platform 600 is on top of the wellhead 950, the manipulator arm 900 may remove, or move to an armed position, the ballistic interrupt of the drone to ballistically arm the drone 10. Once the ballistic interrupt has been removed, the drone may be charged.

Alternatively, when the lubricator 955 receives the charged drone, the lubricator 955 removes or moves the ballistic interrupt to the armed position. The drone is ready to deploy/launch into the wellbore and may be "hot" (i.e., activated and when configured as a perforating gun, able to initiate shaped charges).

To be sure, the drone 10 or a plurality of drones in a magazine may be charged when the drone is in the front most shielded position within the receptacle 401, i.e., a position in the receptacle 401 having metal foam. A user may communicate with the drone at the same time, via a communicative electrical connection on the manipulator arm 900.

According to an aspect, the manipulator arm 900 is configured to move in X, Y and Z directions to engage and move the drone when the platform 600 is adjacent the magazine and also when the platform 600 is adjacent the receptacle 401 in order to select and place a drone into the lubricator 955, when the platform 600 is raised to the height of the lubricator 955. The lubricator 955 is may be secured to the wellhead 950, so that the drone can be delivered from the lubricator 955 to the wellhead 950 and into the wellbore. Once the drone is placed in the lubricator 955, a mechanism coupled to the lubricator 955 can remove or move the ballistic interrupt positioned in the drone, to arm the drone.

It is contemplated that the platform 600 may move up and down the pair of spaced apart side rails 330 at a preset pace/time. For example, the platform 600 may move up and down the pair of spaced apart side rails 330 in about 5 minutes, or less than 3 minutes. The platform 600 may move down the pair of spaced apart side rails 330 at a different speed than the speed for the platform 600 to move up the pair of spaced apart side rails 330. For example, the platform 600 may move down the pair of spaced apart side rails 330 in about 2 minutes and may move up the rail in about 3 minutes.

When the platform 600 has moved down the pair of spaced apart side rails 330 to select a drone 10 from a magazine 100, the drone may have already been charged and/or programmed with instructions for carrying out its wellbore operation while in the magazine 100. For example, the drone 10 may be charged when a lid of a magazine 100 containing the drone 10 is in a closed position. The lid includes contact(s) for engaging complimentary charging/programming contacts on the drone 10. In an aspect, electrical contact/communicative communications between the magazine 100 and the drone 10 may be used to test, e.g., the drone control circuitry, electrical connections, and the like. Should a drone 10 fail a diagnostic test, it may be removed from the magazine 100 or moved to another position within the magazine 100, thereby preventing the manipulator arm 900 from selecting and deploying the drone.

The self-erecting launcher assembly 300 may include an electrical motor (not shown). The electrical motor may be provided on or in the mobile unit 400 or adjacent the mobile unit 400. The electrical motor is configured to run or power both the platform 600 and arm. For example, the electrical motor may help hoist the elevated platform 600 from the mobile unit 400 to an upper end of the pair of spaced apart side rails 330. According to an aspect, the electrical motor is an electrical X-motor (i.e., a motor that generates no sparks, etc.) that is safe for use in an explosive atmosphere. The electrical X-motor is particularly helpful because it does not have the potential limitations of hydraulic unit 450*s* 450.

In an aspect of the exemplary embodiments, the drone 10 is in communication with a control unit 700 via communicative electrical connection(s) between the drone and the manipulator arm 900, which is in electrical or wireless communication with the control unit 700, at all times before the drone is released by the manipulator arm 900 into the lubricator 955. For purposes of this disclosure, electrical communication may include physical electrically communicative connections or wireless communications, such as radio frequency (RF) transmissions, as are known, and the like. The drone can be retrieved, and the delivery aborted, at any time until placement of the drone into the lubricator 955 takes place.

The control unit 700 may include a controller to monitor, for example, the position of the mobile unit 400 on the track rails 800. According to an aspect, the controller controls the movement of at least one of the mobile unit 400, the rotational unit, the conveyor system 430, the platform 600, and the manipulator arm 900. The controller may help to control the process of the deployment of the drones into the wellbore. According to an aspect, the controller plays a supervisory and diagnostic role in monitoring the position and function of at least one of the mobile unit 400, the rotational unit, the conveyor system 430, the platform 600, and the manipulator arm 900.

For example, the mobile unit 400 travels on track rails 800 secured to a ground surface to access and service multiple wellheads 950 (FIG. 8). The controller may monitor the interface between the mobile unit 400 and the track rails 800, as well as the condition of the track rails 800 during normal operation of the self-erecting launcher assembly 300, without interrupting the delivery and deployment of drones into the wellbore 50. The controller may control an imaging device positioned on the mobile unit 400 or the track rails 800 in order to capture still or video images of the mobile unit 400 in operation. The controller may use the capture images to to determine whether irregularities is present in the operation of the self-erecting launcher assembly 300.

A control room 750 may be provided on the wellsite to handle multiple self-erecting launcher assemblies 300 at the same time, or a single self-erecting launcher assembly 300 that services multiple wellheads 950. The control unit 700 may be positioned in the control room 750. The control room 750 is illustrated in FIG. 15. According to an aspect, the control room 750 serves as a central unit/area for personnel to monitor the functionality and operation of the self-erecting launcher assembly 300 and each of its components. According to an aspect, the control room 750 is positioned on a skid so that the control room 750 is movable from one location to another location. The control room 750 may alternatively be positioned on the bed of a truck or a trailer that can be pulled by an automobile, such as a truck. The control room 750 can be equipped with an office space (including desks, computer screens, etc.) that is manned by personnel. The control room 750 may be equipped with a generator or may be plugged in to access other power sources that are available at the well site. Such power sources may include a diesel generator that helps to transition the use of the control room 750 at the wellsite.

One or more magazines 100, such as the magazines 100 described in U.S. Pat. No. 10,605,037 and U.S. Application No. 62/940,480 filed Nov. 26, 2019 and commonly owned by DynaEnergetics Europe GmbH, may be positioned in the magazine loading bay 420 using a forklift 990.

The forklift 990 may include specially designed adjustable forks 995 that engage the underside of a magazine in order to move the magazine 100 to the magazine loading bay 420. According to an aspect, the adjustable forks 995 of the forklift 990 may be customizable in order to ensure compatibility with the base frame of the magazine 100. Most likely the frame size of the magazine will be chosen to be compatible with standard fork-lift dimensions.

Further embodiments of the disclosure may be associated with a method of servicing a plurality of wellheads. The method includes using a self-erecting launcher assembly to deploy a drone into a wellbore. The launcher assembly includes a mobile unit. A forklift or another carrying mechanism may be utilized to move a magazine and position the magazine in a receptacle of the mobile unit. According to an aspect, the magazine moves within an interior of the mobile unit, via a conveyor, for example, to a front portion of the mobile unit. The magazine may be positioned on a platform that is secured to a rail unit. The rail unit, secured to the mobile unit, is moved from a horizontal configuration to a vertical configuration, taking the platform and the magazine with it. The platform may move up the rail unit so that it is at the height of or higher than a lubricator positioned at a wellhead. A manipulator arm, secured to the platform, picks up a drone positioned in the magazine, and places the drone into the lubricator. The manipulator arm may pick up another drone and place it into the lubricator. According to an aspect, the mobile unit may be configured to move between wellheads via wheels or a rotational mechanism. The mobile unit may be positioned on rails that run alongside a plurality of different wellheads, so that the mobile unit can travel along those rails in order to service the different wellheads.

This disclosure, in various embodiments, configurations and aspects, includes components, methods, processes, systems, and/or apparatuses as depicted and described herein, including various embodiments, sub-combinations, and subsets thereof. This disclosure contemplates, in various embodiments, configurations and aspects, the actual or optional use or inclusion of, e.g., components or processes as may be well-known or understood in the art and consistent with this disclosure though not depicted and/or described herein.

The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

In this specification and the claims that follow, reference will be made to a number of terms that have the following meanings. The terms "a" (or "an") and "the" refer to one or more of that entity, thereby including plural referents unless the context clearly dictates otherwise. As such, the terms "a" (or "an"), "one or more" and "at least one" can be used interchangeably herein. Furthermore, references to "one embodiment", "some embodiments", "an embodiment" and the like are not intended to be interpreted as excluding the existence of additional embodiments that also incorporate the recited features. Approximating language, as used herein throughout the specification and claims, may be applied to modify any quantitative representation that could permissibly vary without resulting in a change in the basic function to which it is related. Accordingly, a value modified by a term such as "about" is not to be limited to the precise value specified. In some instances, the approximating language may correspond to the precision of an instrument for measuring the value. Terms such as "first," "second," "upper," "lower" etc. are used to identify one element from another, and unless otherwise specified are not meant to refer to a particular order or number of elements.

As used herein, the terms "may" and "may be" indicate a possibility of an occurrence within a set of circumstances; a possession of a specified property, characteristic or function; and/or qualify another verb by expressing one or more of an ability, capability, or possibility associated with the qualified verb. Accordingly, usage of "may" and "may be" indicates that a modified term is apparently appropriate, capable, or suitable for an indicated capacity, function, or usage, while taking into account that in some circumstances the modified term may sometimes not be appropriate, capable, or suitable. For example, in some circumstances an event or capacity can be expected, while in other circumstances the event or capacity cannot occur—this distinction is captured by the terms "may" and "may be."

As used in the claims, the word "comprises" and its grammatical variants logically also subtend and include phrases of varying and differing extent such as for example, but not limited thereto, "consisting essentially of" and "consisting of." Where necessary, ranges have been supplied, and those ranges are inclusive of all sub-ranges therebetween. It is to be expected that the appended claims should cover variations in the ranges except where this disclosure makes clear the use of a particular range in certain embodiments.

The terms "determine", "calculate" and "compute," and variations thereof, as used herein, are used interchangeably and include any type of methodology, process, mathematical operation or technique.

This disclosure is presented for purposes of illustration and description. This disclosure is not limited to the form or forms disclosed herein. In the Detailed Description of this disclosure, for example, various features of some exemplary embodiments are grouped together to representatively describe those and other contemplated embodiments, configurations, and aspects, to the extent that including in this disclosure a description of every potential embodiment, variant, and combination of features is not feasible. Thus, the features of the disclosed embodiments, configurations, and aspects may be combined in alternate embodiments, configurations, and aspects not expressly discussed above. For example, the features recited in the following claims lie in less than all features of a single disclosed embodiment, configuration, or aspect. Thus, the following claims are hereby incorporated into this Detailed Description, with each claim standing on its own as a separate embodiment of this disclosure.

Advances in science and technology may provide variations that are not necessarily express in the terminology of this disclosure although the claims would not necessarily exclude these variations.

What is claimed is:

1. A self-erecting launcher assembly comprising:

a mobile unit comprising a receptacle;

a magazine including a plurality of drones positioned in the receptacle;

a rail unit secured to the mobile unit, the rail unit movable between a closed position and an elevated position; and a platform secured to the rail unit and movable in an upward direction and a downward direction along a length of the rail unit, wherein the platform moves the magazine or the plurality of drones from the mobile unit to at least one wellhead.

2. The self-erecting launcher assembly of claim 1, wherein the mobile unit further comprises a magazine loading bay in communication with the receptacle.

3. The self-erecting launcher assembly of claim 1, wherein the mobile unit further comprises:

a conveyor system in the receptacle; and a magazine retrieval zone in communication with the receptacle, wherein the conveyor system is configured to move the magazine from the magazine loading bay to the magazine retrieval zone.

4. The self-erecting launcher assembly of claim 3, wherein the magazine is configured to move within the receptacle to the magazine retrieval zone via the conveyor system.

5. The self-erecting launcher assembly of claim 1, further comprising:

a ballistic limiter configured to prevent or limit ballistic transfer from a first drone to a second drone positioned in the magazine in the event of detonation of an explosive component of the first drone.

6. The self-erecting launcher assembly of claim 1, wherein the rail unit further comprises:

a pair of spaced apart side rails, wherein a first rail of the pair of spaced apart side rails includes a first end pivotably connected to the mobile unit, and a second end spaced apart from the first end, and a second rail of the pair of spaced apart side rails includes a first end pivotably connected to the mobile unit, and a second end spaced apart from the first end.

7. The self-erecting launcher assembly of claim 6, further comprising:

a pair of telescoping arms, wherein a first telescoping arm of the pair of telescoping arms is configured to move a first rail of the pair of spaced apart side rails, and a second telescoping arm of the pair of telescoping arms is configured to move a second rail of the pair of spaced apart side rails.

8. The self-erecting launcher assembly of claim 7, wherein the first telescoping arm is connected to the first rail at a position between the first end and the second end of the first rail, and the second telescoping arm is connected to the second rail at a position between the first end and the second end of the second rail.

9. The self-erecting launcher assembly of claim 1, further comprising:

a manipulator arm secured to the platform, wherein the manipulator arm is configured to select a drone of the plurality of drones and delivers the selected drone into a lubricator.

10. The self-erecting launcher assembly of claim 1, further comprising:

a control unit configured to communicate with at least one of the mobile unit, the magazine, the plurality of drones, the rail unit, the platform, the manipulator arm, and an electrical motor.

11. A wellbore deployment system comprising:

a plurality of self-erecting launcher assemblies, each self-erecting launcher assembly of the plurality of self-erecting launcher assemblies comprising:

a mobile unit comprising a receptacle;

a magazine including a plurality of drones positioned in the receptacle;

a rail unit secured to the mobile unit, the rail unit movable between a closed position and an elevated position;

a platform secured to the rail unit and movable in an upward direction and a downward direction along a length of the rail unit, wherein the platform moves the magazine or the plurality of drones from the mobile unit to at least one wellhead; and a control unit configured to manage functionality and operation of the plurality of self-erecting launcher assemblies.

12. The wellbore deployment system of claim 11, wherein the mobile unit comprises:

at least one side wall having an upper portion and a lower portion;

a roof connected to the upper portion of the at least one side wall; and a floor connected to the lower portion of the at least one side wall, wherein the receptacle is bounded by the at least one side wall, the roof and the floor.

13. The wellbore deployment system of claim 12, wherein the mobile unit further comprises a magazine loading bay in communication with the receptacle.

14. The wellbore deployment system of claim 13, wherein the magazine loading bay is positioned in the at least one side wall.

15. The wellbore deployment system of any one of claim 11, wherein the rail unit further comprises:

a pair of spaced apart side rails, wherein a first rail of the pair of spaced apart side rails includes a first end pivotably connected to the mobile unit, and a second end spaced apart from the first end, and a second rail of the pair of spaced apart side rails includes a first end pivotably connected to the mobile unit, and a second end spaced apart from the first end.

16. A wellbore deployment system comprising:

a self-erecting launcher assembly comprising:

a mobile unit comprising a receptacle;

a magazine positioned in the receptacle, the magazine including a plurality of drones;

a rail unit secured to the mobile unit, the rail unit movable between a closed position and an elevated position;

a platform secured to the rail unit and movable in an upward direction and a downward direction along a length of the rail unit; and a location adjuster configured to move the self-erecting launcher assembly from a first wellhead to additional wellheads.

17. The wellbore deployment system of claim 16, wherein the location adjuster comprises at least one of:

a plurality of wheels secured to the mobile unit; and a track rail.

18. The wellbore deployment system of claim 16, wherein the location adjuster comprises:

a rotational unit, wherein the mobile unit is positioned on the rotational unit, and the mobile unit is movable between a first wellhead and additional wellheads.

19. The wellbore deployment system of claim 16, wherein the location adjuster comprises:

a scissor lift configured to move the mobile unit in an upward direction to the height of the wellhead.

20. The wellbore deployment system of claim 16, wherein the rail unit further comprises:

a pair of spaced apart side rails, wherein a first rail of the pair of spaced apart side rails includes a first end pivotably connected to the mobile unit, and a second end spaced apart from the first end, and a second rail of the pair of spaced apart side rails includes a first end pivotably connected to the mobile unit, and a second end spaced apart from the first end.

* * * * *